US006854242B2

(12) United States Patent
Stork et al.

(10) Patent No.: US 6,854,242 B2
(45) Date of Patent: Feb. 15, 2005

(54) MODULAR SHRINK-WRAP MACHINE

(75) Inventors: Brian R. Stork, Washington, MO (US); Roger L. Gassel, Ellisville, MO (US); Tom Wilson, Washington, MO (US)

(73) Assignee: Stork Fabricators, Inc., Washington, MO (US)

( * ) Notice: Subject to any disclaimer, the term of this patent is extended or adjusted under 35 U.S.C. 154(b) by 95 days.

(21) Appl. No.: 10/036,029

(22) Filed: Oct. 29, 2001

(65) Prior Publication Data

US 2002/0055803 A1 May 9, 2002

Related U.S. Application Data

(60) Provisional application No. 60/244,360, filed on Oct. 30, 2000.

(51) Int. Cl.[7] ..... B65B 57/10

(52) U.S. Cl. ..... 53/53; 209/73; 209/203; 209/209

(58) Field of Search ..... 53/52, 493, 496, 53/203, 209, 218, 56, 57, 58, 51, 73, 588; 242/554, 554.1, 555.3, 563, 571, 578, 578.1, 586, 590, 597; 226/154, 155

(56) References Cited

U.S. PATENT DOCUMENTS 3,795,370 A * 3/1974 Dean ..... 242/536
3,837,591 A * 9/1974 Clarke ..... 242/573.4
3,900,141 A * 8/1975 Duckworth ..... 226/53
3,974,623 A * 8/1976 Bate ..... 53/452
4,040,043 A * 8/1977 Stanford ..... 242/421.1
4,132,402 A * 1/1979 Morrison et al. ..... 271/263
4,149,681 A * 4/1979 Schluter ..... 242/575
4,426,883 A * 1/1984 Inoue et al. ..... 73/159
4,553,368 A 11/1985 Ziller
4,706,442 A * 11/1987 Riemenschneider ..... 53/556
4,856,724 A * 8/1989 Jespersen ..... 242/560.1
5,153,625 A * 10/1992 Weber ..... 396/284
5,303,811 A 4/1994 Haley
5,337,542 A * 8/1994 Omori ..... 53/550
5,378,304 A 1/1995 Denker
5,441,210 A * 8/1995 Hinton ..... 242/421.1
5,524,413 A * 6/1996 Fukuda ..... 53/64
5,558,302 A * 9/1996 Jesperson ..... 242/560
5,689,942 A * 11/1997 Suga ..... 53/550
5,799,470 A * 9/1998 Sautter et al. ..... 53/550
5,894,709 A * 4/1999 Fosshage ..... 53/450
6,484,475 B1 * 11/2002 Neagle et al. ..... 53/167

* cited by examiner

*Primary Examiner*—Scott A. Smith
*Assistant Examiner*—Gloria R. Weeks
(74) *Attorney, Agent, or Firm*—Peter S. Gilster; Greensfelder, Hemker & Gale, P.C.

(57) ABSTRACT

Selectively reconfigurable shrink-wrap machine (30) for use with a loading device (34) for individually wrapping products (58) sequentially with shrink-wrap material (92) as delivered in sequence to the machine. It includes a sensor (62) sensing product position on the loading device. Shrink-wrap material is delivered from a roll at a wrapping station (40). A first conveyor (42) carries wrapped products between the wrapping station and a film sealing and cutting apparatus (44). First conveyor delivers products sequentially in synchronized velocity with the loading device in response to sensor signals. Film sealing and cutting apparatus has upper and lower heads (156, 164), at least one of which is driven into and out of engagement with the other between adjacent wrapped products received by the first conveyor for effecting a sealed cut between them. Heads are each maintained at a fixed angle of orientation. A second conveyor (43) receives wrapped products sequentially from the sealing and cutting apparatus. A microprocessor-driven touch screen (48) and a method controls the shrink-wrap machine and is described.

14 Claims, 20 Drawing Sheets

MODULAR SHRINK-WRAP MACHINE

CROSS-REFERENCE TO RELATED APPLICATION

This application is based upon and claims priority of United States Provisional Patent Application entitled Modular Shrink-Wrap Machine, Ser. No. 60/244,360, filed 30 Oct. 2000.

BACKGROUND OF THE INVENTION

Field of the Invention

The invention relates to apparatus for wrapping products with heat shrinkable film and, more particularly, to a high-speed modular shrink-wrap system for individually wrapping products sequentially with shrink-wrap material.

Many arrangements have been known or proposed for wrapping of products with heat-sealable or heat-shrinkable film material. Co-assigned Stork U.S. Pat. No. 5,956,931 shows an apparatus for wrapping products in which products are provided to a delivery conveyor, wrapped in a tube of heat-sealable material, and to a sealing station wherein sealing heads are brought into and out of engagement with a tube to cut and seal the plastic, i.e. film material forming the tube. The products, which are delivered as wrapped packages onto an exit conveyor, proceed into a heat-shrink station for final processing and discharge. That patent describes an arrangement for positioning and movement of the sealing heads which can be readily adjusted, as by operator input. Movement of the head is detected by an electric eye which determines relative dimensions of the product for initiating appropriate movement of the sealing head or heads.

In addition, it has also been proposed to use computer software programs for controlling the operation of such shrink-wrap machines wherein the software can provide operator input to define movement of sealing heads and other characteristics appropriate to the type of seal, such fin seal, static seal, lap seal and other types of seals, using machinery of this type.

It has also been proposed to use vacuum conveyors for maintaining a package into tractive adherence, while wrapped in a tube sealing material, while the product is brought into a sealing position.

It has been proposed to use orbitally reciprocating sealing heads or apparatus for sealing and severing each film-wrapped package from each other, including with continuous motion of the product on such a vacuum conveyor as it moves through the sealing section and into an exit region and before heat-shrinking of the film material about the wrapped product.

However, these prior art arrangements have not fully achieved the speed and throughput or ease of adjustment and change desired by customers. It has been found by the present inventors that speed and throughput can be improved by more accurate sensing of the position of products as they move from a delivery conveyor into a heat sealing station, and by precisely controlling the movement of sealing heads as they are brought into and out of engagement with a tube of film material that wraps a product.

One of the challenges which face manufacturers of this type of equipment is the need for the equipment to accommodate many different types of products, widths, heights and shapes, as are dictated by the uses to which the machines will be put. Heretofore, prior art packaging systems and film-wrapping apparatus have not provided to the full extent desired accommodation to these various needs which will allow changes to be rapidly and effectively carried out by an operator by simple control input, as compared with time-consuming and difficult mechanical adjustments of features. It is desirable to provide equipment of this scope with a high degree of both mechanical and electrical changeability for providing modular characteristics, by which both mechanical and electrical features can be changed by the substitution of modules or by software-implemented changes under the control of an operator.

In apparatus of this type, installation may require the operator to be positioned on either side of the machine relative to the direction of movement of products through the machine. The location of an operator may depend upon assembly line constraints. For example, in replacement of existing equipment, a new machine may require that the operator stand on one side which is the same as in operating a previous machine. Further, in some installations, a single operator may be desirably positioned between two product wrapping lines so that, for example, product on one line will move from right to left from the operator's perspective, but when the operator faces in an opposite direction, will move from left to right. Therefore, it is desirable that machines of this character be ambidextrous in character, if possible, so as to allow an operator to be located on either side of the machine.

SUMMARY OF THE INVENTION

Among the several objects, features and advantages of the present invention may be noted the provision of automatic packaging systems for wrapping products with film material, forming a preselected type of package seal and for separating film material wrapped about the product so as to provide individually wrapped packages, which:

- achieves extremely high speed and throughput;
- during operation is capable of sensing precisely the position of packages entering the machine;
- when sensing the position of packages uses electronic, microprocessor-controlled sensing of the position of products to quickly and precisely bring cutting and sealing heads into and out of engagement with products;
- operates by wrapping, sealing and separating the wrapped packages by using smooth, synchronized operation of sealing and cutting heads in such a way as to avoid wasted, lost motion;
- allows ready changeability of both mechanical and electronic features by employing modular components;
- a allows quick operator reconfiguration in a facile manner without costly set-up or time-consuming mechanical adjustments;
- during change and adjustment allows software input to be quickly and effectively made by display screen input;
- allows processor-implemented changes to be carried out electronically rather than mechanically;
- is capable of ambidextrous use to permit an operator to be located on either side of the collection of movement of packages through the apparatus;
- allows an operator input device to be reoriented to either side of the machine; and
- allows rapid changing or reloading of film material to either side of she machine, being readily configurable for that purpose.

Briefly, a selectively reconfigurable shrink-wrap machine for use with a loading device for individually wrapping products sequentially with shrink-wrap material. The loading device delivers products in sequence to the machine for wrapping with shrink-wrap material. Further, the shrink-wrap machine includes a sensor associated with the loading device for sensing product position on the loading device. Additionally, a film supply presents a roll of shrink-wrap material that is associated with a wrapping station at which products are wrapped with film material from the film supply.

A first conveyor carries products wrapped in the film material between the wrapping station and a film sealing and cutting apparatus. Moreover, the first conveyor is driven to deliver products sequentially in synchronized velocity with the loading device in response to signals generated by the sensor.

The film sealing and cutting apparatus has an upper head and a lower head. At least one the heads is driven for movement into and out of engagement with the other head between adjacent film wrapped products received by the first conveyor for effecting a seal between adjacent products. Moreover, the upper head and the lower head are each maintained at a fixed angle of orientation relative to a direction of movement of products along the first conveyor. A second conveyor is disposed adjacent the film sealing and cutting apparatus for receiving wrapped products sequentially from the sealing and cutting apparatus. As products are delivered by the first conveyor, the film sealing and cutting apparatus sequentially seals and cuts the products.

A microprocessor-driven control system has a touch sensitive viewing and controlling means for prompting and receiving operator response for controlling operation of the shrink-wrap machine. The control system has microprocessor circuits selectively programmed for control of at least one of a plurality of different possible wrapping stations or modes of operation.

Other objects, features and advantages will be in part apparent and in part pointed hereinbelow.

BRIEF DESCRIPTION OF DRAWINGS

Corresponding reference characters identify corresponding elements throughout the several views of the drawings.

DESCRIPTION OF PRACTICAL EMBODIMENTS

Figure 1:
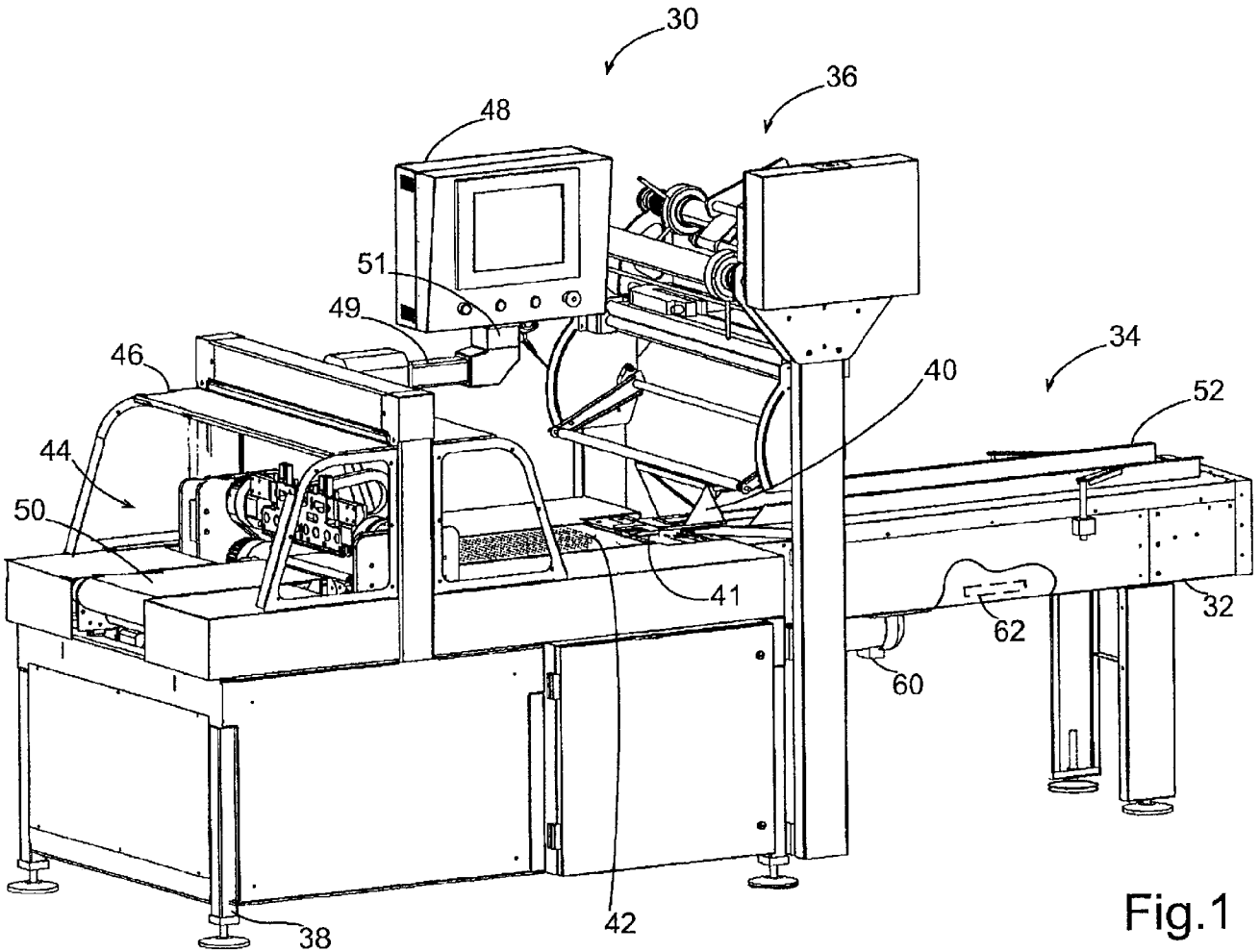
FIG. 1 is a perspective view of apparatus for automatically wrapping products in thermoplastic film, in accordance with and embodying of the present invention.
Figure 2:
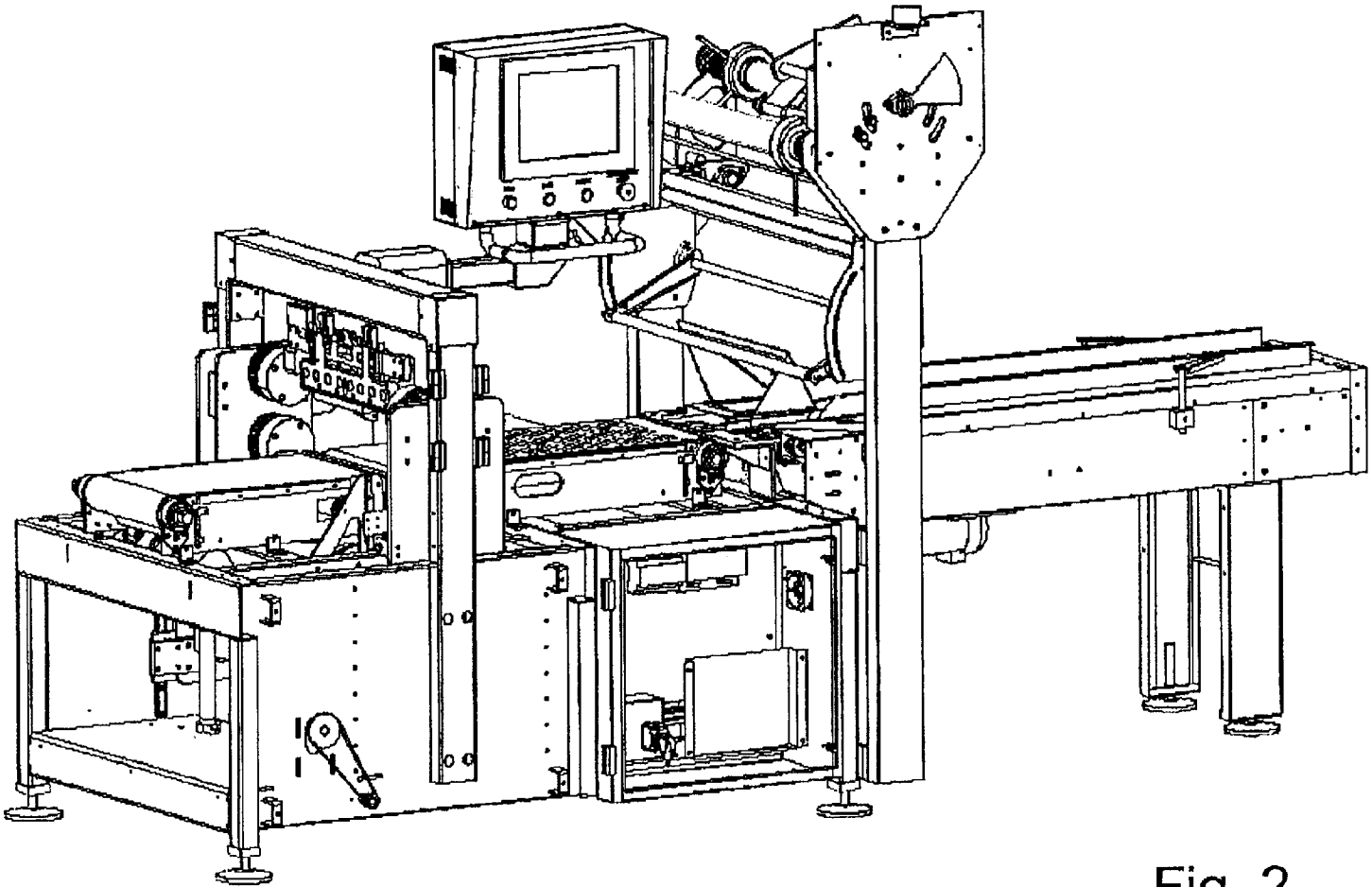
FIG. 2 is a similar view with certain panels removed for clarity.
Figure 3:
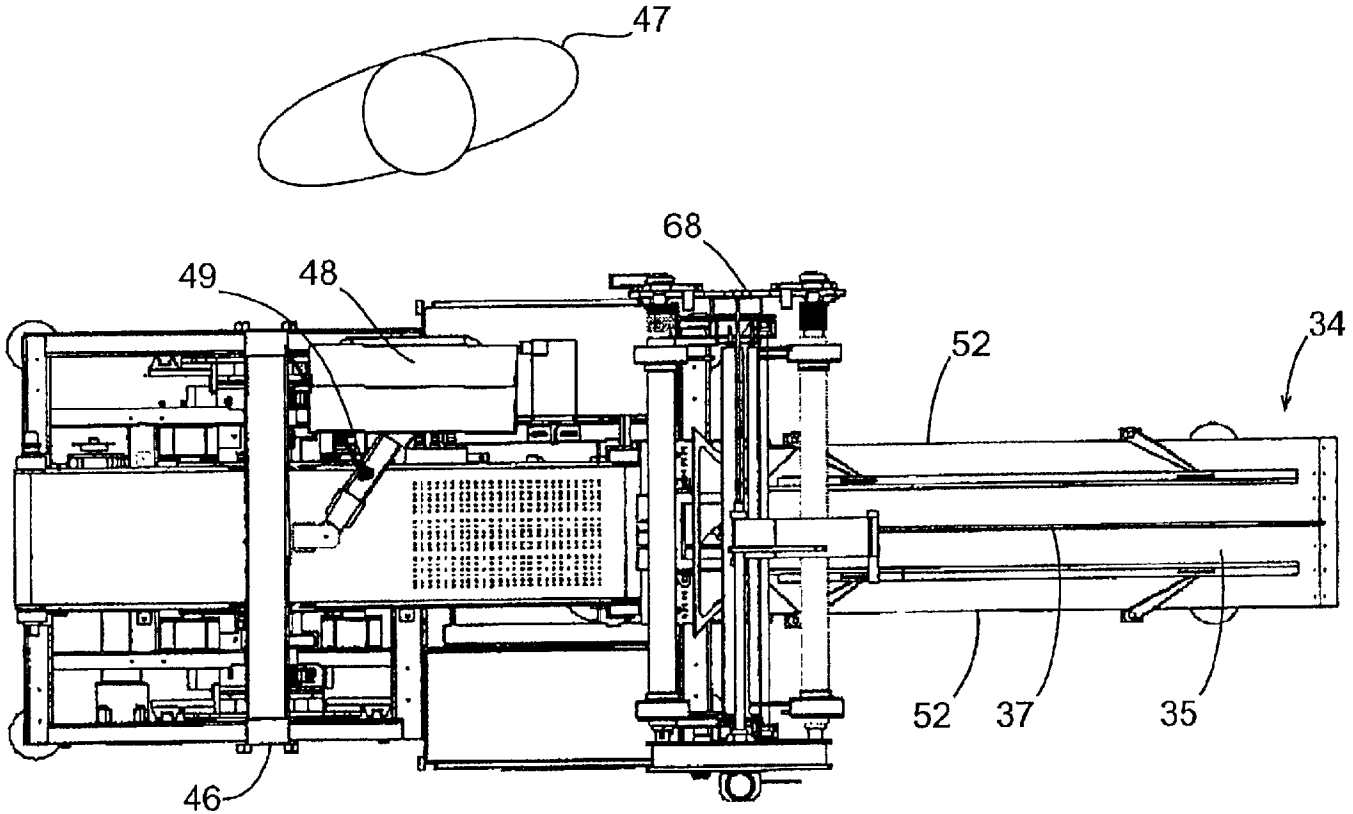
FIG. 3 is a simplified plan view of the apparatus of FIG. 1.

Referring to the drawings, the new shrink-wrap machine is generally indicated at 30 in FIG. 1. Referring to FIGS. 1–3, shrink-wrap machine 30 comprises a support frame 32 which supports a loading conveyor 34. As further shown, a wrapping station 40 is disposed adjacent support frame 32. Additionally, a film dispensing station 36 is disposed adjacent wrapping station 40. A support frame 38 secures a vacuum conveyor 42 which is disposed adjacent film dispensing station 36. Support frame 38 secures exit conveyor 50 which is disposed a predetermined distance from vacuum conveyor 42 with a film sealing and cutting apparatus 44 interposed therebetween. A guard frame 46 which encloses film sealing and cutting apparatus 44, pivotally secures touch sensitive monitor 48.

Figure 3A:
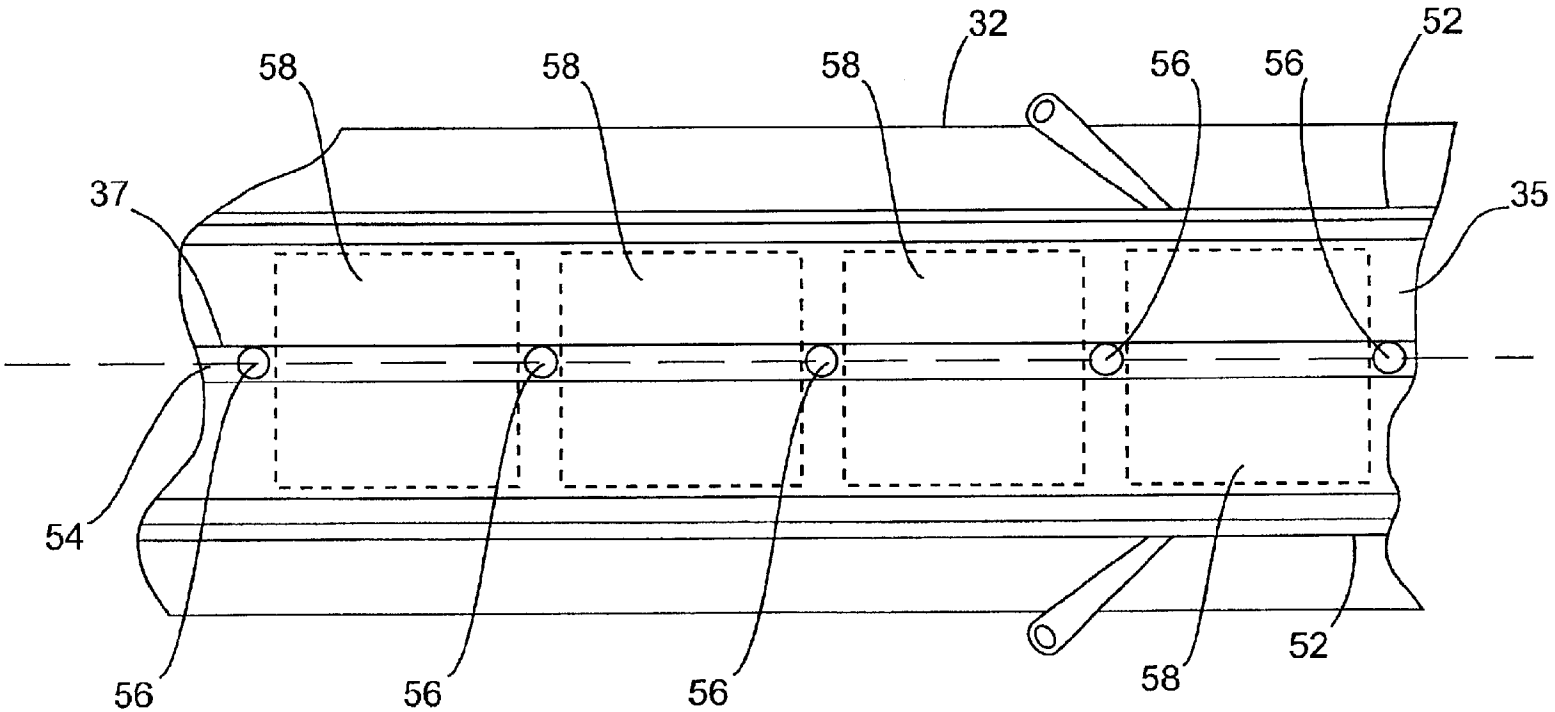
FIG. 3A is an enlarged plan view of the loading conveyor of FIG. 3.

As shown in FIGS. 1, 3 and 3A, loading conveyor 34 comprises a support frame 32 for securing a slotted belt 54 which proceeds in a longitudinal direction along loading conveyor 34 beneath loading surface 35. A longitudinal slot 37 is formed in loading surface 35, exposing belt 54. Further, opposing guides 52 which run longitudinally along loading surface 35, may be selectively separated to correspond to the width of products 58 proceeding longitudinally along loading conveyor 34. To maintain a predetermined spacing between adjacent products 58, multiple equidistantly spaced product propelling means 56, preferably lugs, are inserted in slotted belt 54. Slotted belt 54 is driven by a motorized means 60, preferably a permanent magnet D.C. motor. A sensor 62 (not shown but represented by dashed line in FIG. 1) is disposed along belt 54 for sensing the position of lugs 56 as lugs 56 travel past sensor 62. As can be appreciated by one skilled in the art, sensor 62 generates electrical signals in accordance with the Hall Effect. Using these generated electric signals permits shrink-wrap machine 30 to synchronize belt speeds and effect precise control of product 58 position during operation.

Figure 7:
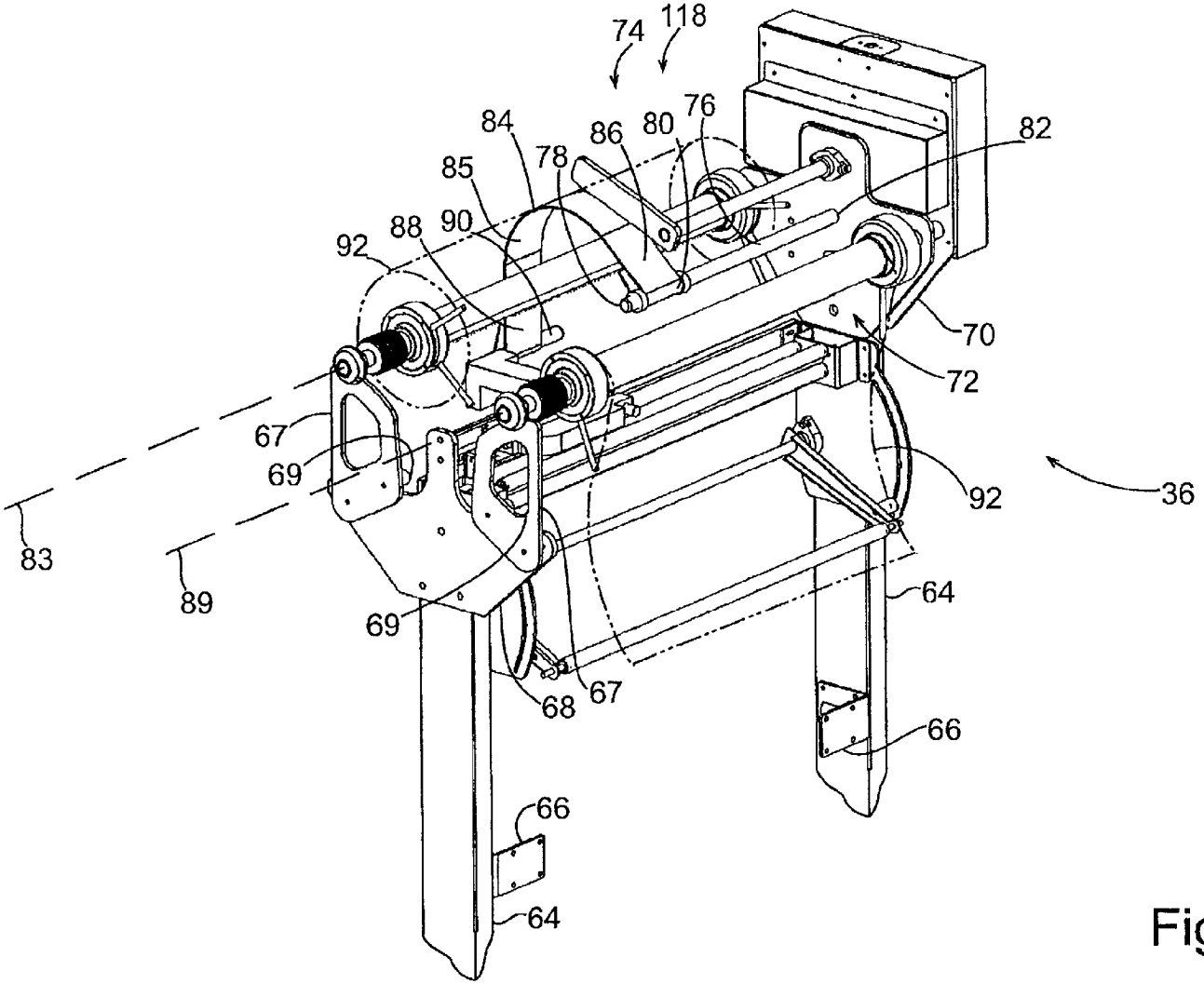
FIG. 7 is a perspective view of film supply apparatus of the invention.

Referring to FIGS. 1 and 7, film dispensing station 36 is explained. Film dispensing station 36 is comprised of a pair of vertical support members 64 which are securely connected to support frame 38 by brackets 66. Further, a proximally positioned vertical support member 64 is securely connected to an open support end 68 having a pair of pivoting members 67 which are prevented from pivoting by pins 69. A distally positioned vertical support member 64 is securely connected to a closed support end 70. A spindle member 72 is disposed between open support end 68 and closed support end 70 for carrying a roll of film material 92 thereon. Access for removal of a roll of film material is effected by actuating pin 69 whereby member 67 pivots to position 71. As is shown in FIG. 7, film dispensing station 36 may accommodate two separate rolls of film material 92.

Figure 8:
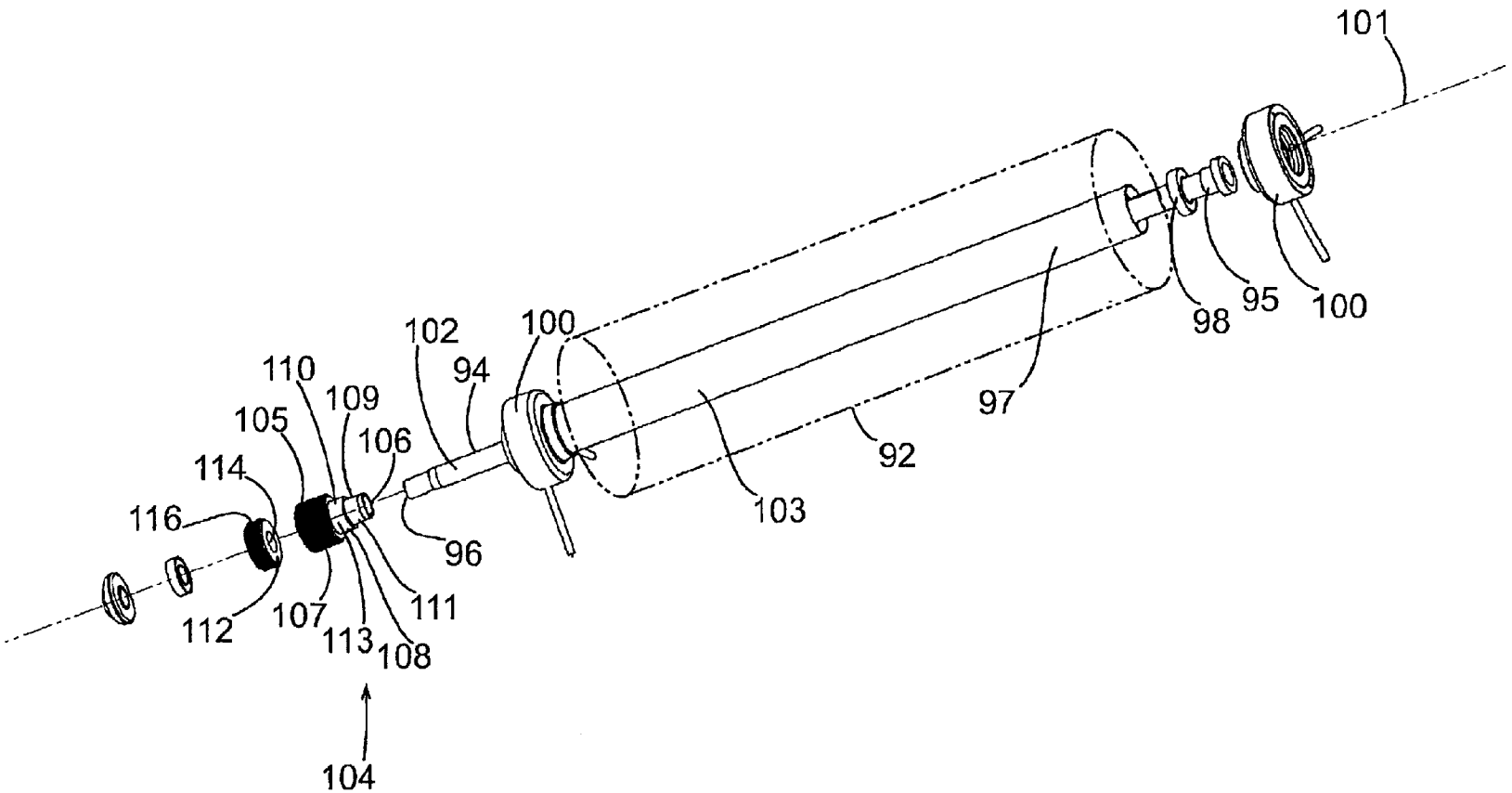
FIG. 8 is an exploded view of a film supply spindle and spindle positioning components of the apparatus of FIG. 7.

Referring to FIGS. 7 and 8, spindle member 72 is further disclosed. Spindle member 72 comprises a central shaft 94 which further includes a distal end 95 and a proximal end 96. Distal end 95 is non-rotatably attached to closed support end 70. An outer shaft 97 which further includes an inside surface 99 and an outside surface 103 slides over central shaft 94 and is maintained in concentric rotational proximity along longitudinal axis 101 by multiple bearings 98. A pair of locking collars 100 are slidably fitted upon opposing ends of outer shaft 97 for securing a roll of film material 92 therebetween. As is further shown, central shaft 94 includes a threaded portion 102 along its proximal end 96. Adjustment collar 104 includes a proximal segment 107 having a knurled gripping surface 105 and a distal segment 109 having an outside surface 111. Adjustment collar 104 further includes a knurled gripping surface 105 for ready operator adjustment. Additionally, a ring 108 having an inside surface 110 and an outside surface 113 is fitted upon outside surface 111 establishing a press fit therebetween.

Although shown in FIG. 8 in an exploded view, outside surface 113 of ring 108 of adjustment collar 104 is assembled into inside surface 99 of outer shaft 97. Therefore, adjustment collar 104, ring 108 and outer shaft 97 are of integral construction. Thus, one of ordinary skill in the art can appreciate that as adjustment collar 104 is rotated about longitudinal axis 101 after being placed in threaded engagement with central shaft 94, as adjustment collar 104 proceeds in either direction along longitudinal axis 101, outer shaft 97 likewise proceeds along longitudinal axis 101 due to the integral construction between adjustment collar 104 and outer shaft 97. Moreover, locking nut 112 has a knurled gripping surface 116 and an internally threaded aperture 114 that may be placed in threaded engagement with threaded portion 102. By grasping knurled gripping surface 116 and rotating locking nut 112 along longitudinal axis 101 in a direction toward adjustment collar 104 until there is secure contact therebetween, locking nut 112 will prevent adjustment collar 104 from rotating with respect to central shaft 94. It is appreciated that this arrangement permits an operator to move a film roll 92 in either direction along longitudinal axis 101 by rotating adjustment collar 104 which is in threaded engagement with central shaft 94 in a desired direction along longitudinal axis 101 while the shrink-wrap machine 30 of the present invention is in operation.

Referring to FIG. 7, retarding device 74 is shown. Retarding device 74 includes an elongated member 76 having a proximal end 78 and recessed region 80 immediately adjacent proximal end 78. Further, distal end 82 is securely connected in closed support end 70. Retarding device 74 is configured to receive a flexible retarding member 84. Flexible retarding member 84 includes a first loop 86 which is pivotally engaged with recessed region 80 of elongated member 76 and a second loop 88 that secures a weight 90 for maintaining retarding member 84 in position. As shown, flexible retarding member 84 extends over and around the periphery of a roll of film material 92, providing non-marring frictional resistance to rotation of a roll of, film material 92 about longitudinal axis 83, 89 while dispensing film material 92 about products 58. The frictional resistance that is generated between inner surface 85 and the periphery of a roll of film material 92 is not specifically shown, as film material 92 is depicted in phantom lines for purposes of clarity. It is appreciated that this frictional force will tend to minimize the amount of unrestricted dispensing of film material 92 when wrapping operation is halted.

Figure 9:
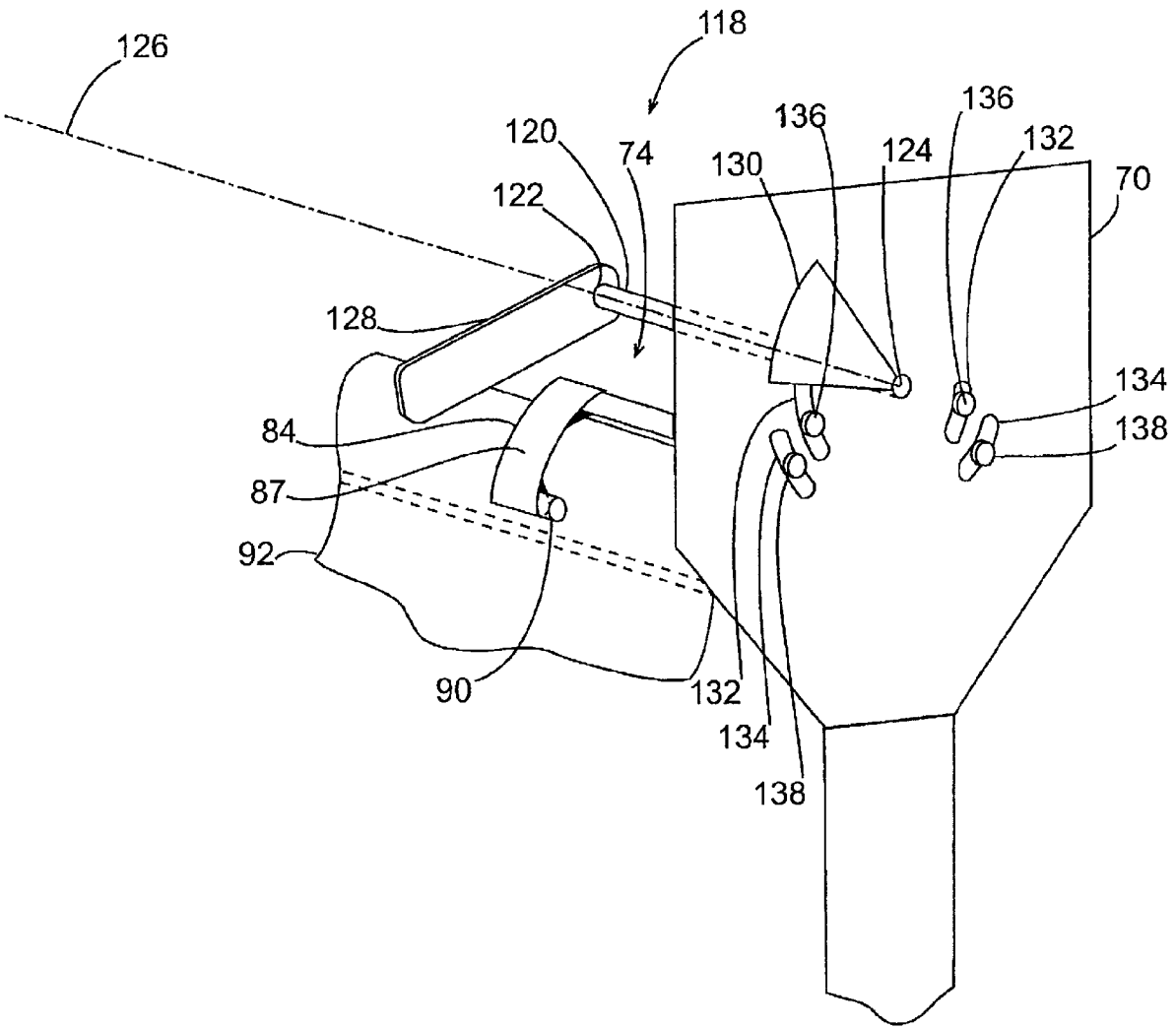
FIG. 9 is a perspective view of a film quantity sensing apparatus.

Referring to FIG. 9, indexing device 118 is further illustrated. Index device 118 includes an elongated portion 120 having a proximal end 122 and a distal end 124. As is shown, elongated portion 120 protrudes through closed support end 70 so that elongated portion 120 may rotate about its longitudinal axis 126. Further, a first sensing member 128 extends radially from proximal end 122, and second sensing member 130 extends radially from distal end 124. First sensing member 128 and second sensing member 130 are situated in a predetermined angular relationship with each other and with respect to longitudinal axis 126. As is further shown, a first curved slot 132 and a second curved slot 134 is formed in closed support end 70. Additionally, a first sensing device 136 and a second sensing device 138 are disposed in first curved slot 132 and second curved slot 134, respectively for sensing a predetermined extent of depletion and total depletion, respectively, of a roll of film material 92. It is further appreciated that a second set or pair of curved slots and sensing devices are provided as film dispensing station 36 is configured to secure two rolls of film material 92. Sensing devices 136, 138 operate in accordance with the Hall Effect and send electrical signals when second sensing member 130 passes in sufficiently proximately therewith. Additionally, an operator warning device (not shown) may be provided for warning an operator of a predetermined extent of depletion or total depletion, respectively, of a roll of film material 92.

Referring to FIG. 9, first sensing member 128 rests atop outer surface 87 of flexible retarding member 84 for monitoring the amount of shrink-wrap material 92 remaining on a roll. Second sensing member 130 is pivotally adjacent first and second sensing devices 136, 138. As the roll of shrink-wrap material 92 is expended, first sensing member 128 maintains an offset tangential contact along the radius of the roll. This offset is due to the thickness of the flexible retarding member 84 as first sensing member 128 rotates about longitudinal axis 126 of the elongated portion 120. Likewise, second sensing member 130 rotates about longitudinal axis 128. As the film roll of shrink-wrap material 92 is expended to a predetermined level, second sensing member 130 achieves such proximity with first sensing device 128 as to activate first sensing device 136 and thereby alert an operator of a predetermined level of depletion of film material 92 from a film roll. Upon the roll being totally expended of film material 92, second sensing member 130 achieves such proximity with second sensing device 138 as to activate second sensing device 138 thereby alerting the operator that film material 92 of a film roll has been totally expended.

Figure 11:
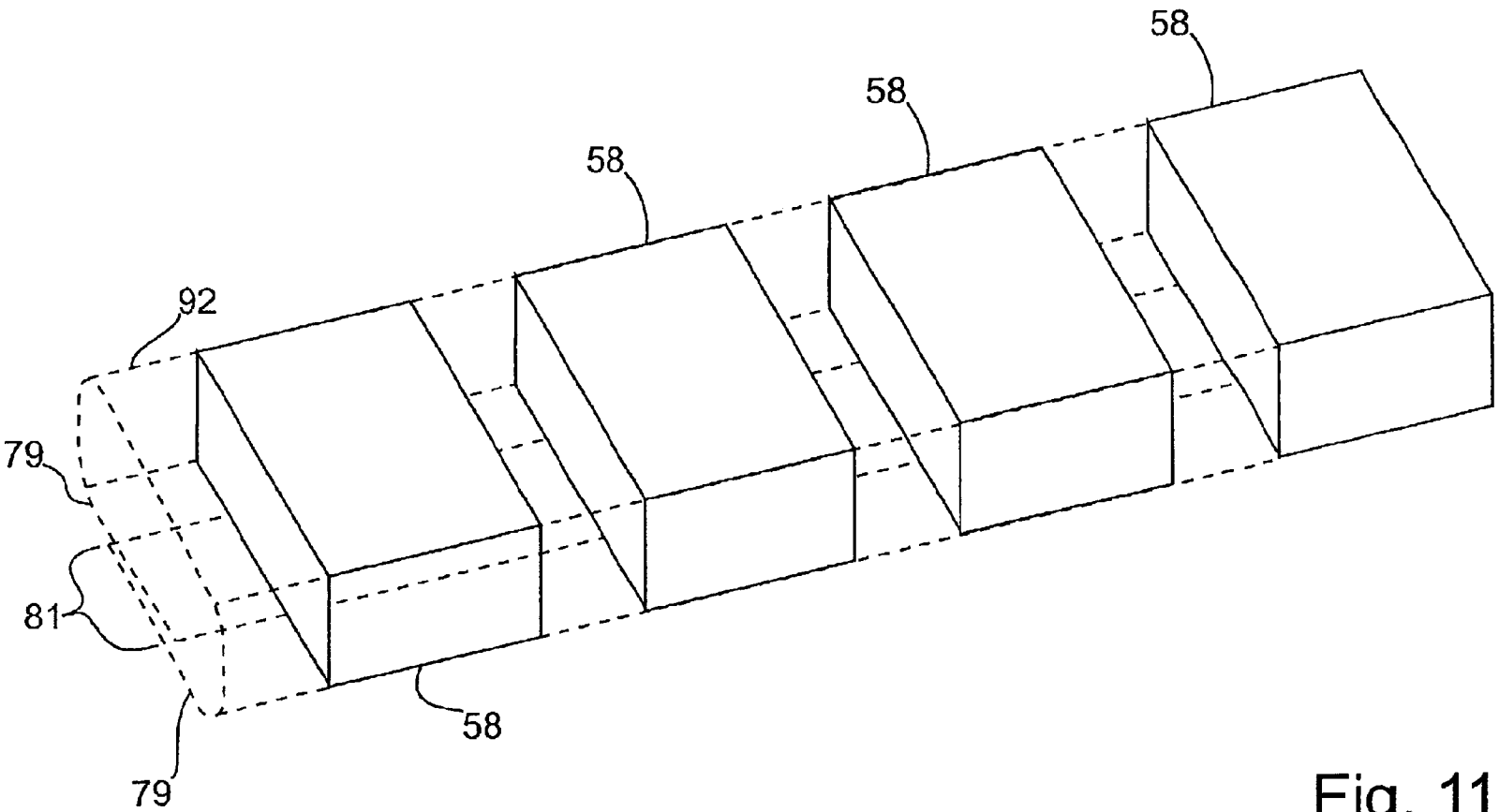
FIG. 11 is a perspective view of products along the vacuum conveyor.
Figure 11B:
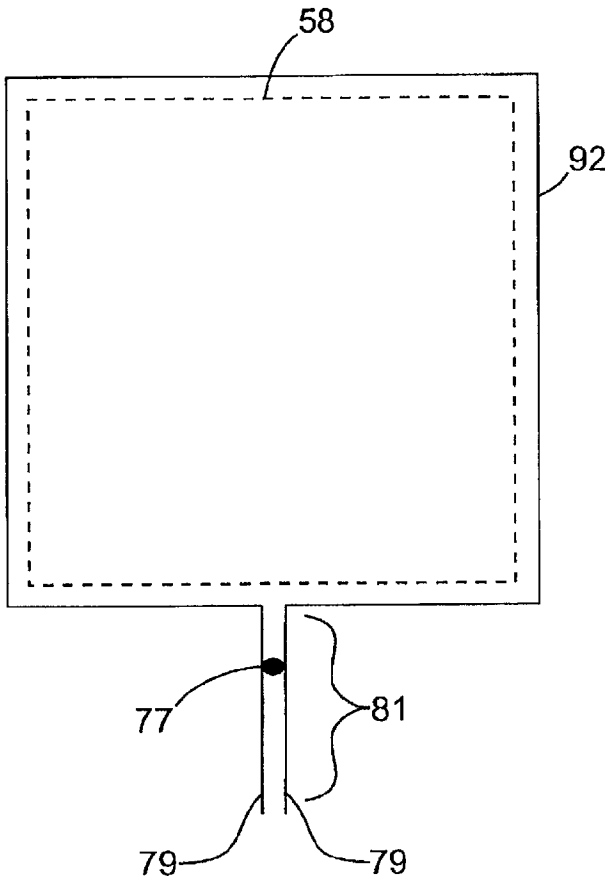
FIG. 11B is an end view illustrating a product wrapped in film material having a fin seal.
Figure 11A:
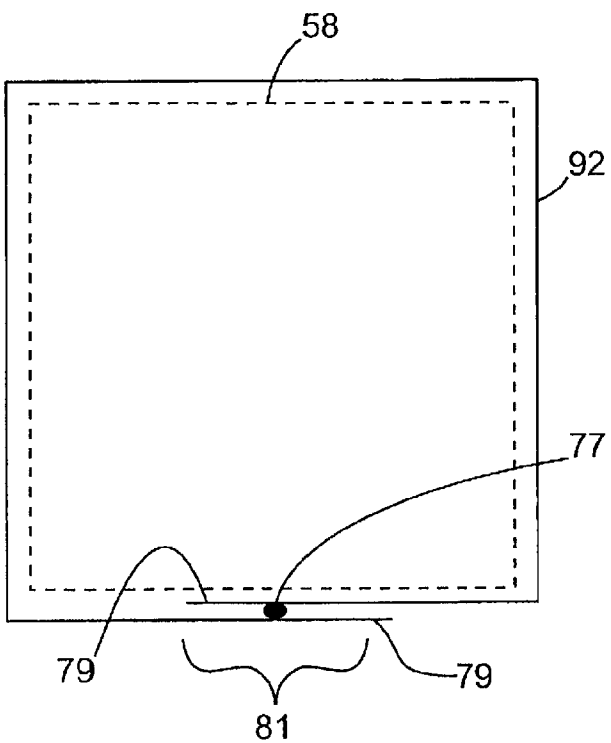
FIG. 11A is an end view illustrating a product wrapped in film material having a static seal.

Referring to FIGS. 1 and 3, wrapping station 40 is disposed adjacent loading conveyor 34 for receiving products propelled by lug 56. Wrapping station 40 is well known in the art, using film material 92 for wrapping product 58 by directing film material 92 from film dispensing station 36 to closely wrap products 58 peripherally along their longitudinal axes within a continuous tube 93 of film material 92 so that tube 93 is formed therearound product 58 (FIG. 11). Referring to FIG. 11A, an overlapping region 81 is formed between opposed ends 79 of film material 92. A sealing device 41 (FIG. 1) disposed adjacent wrapping station 40 establishes a continuous seam 77 along overlapping region 81. Referring to FIG. 1, wrapping station 40 establishes a static seal. Although different types of wrapping stations are used to form different kinds of seals (FIGS. 11A, 11B), which are also known in the art, shrink-wrap machine 30 of the present invention provides for modular wrapping stations 40 which may be selectively installed according to a customer's preference.

Figure 6A:
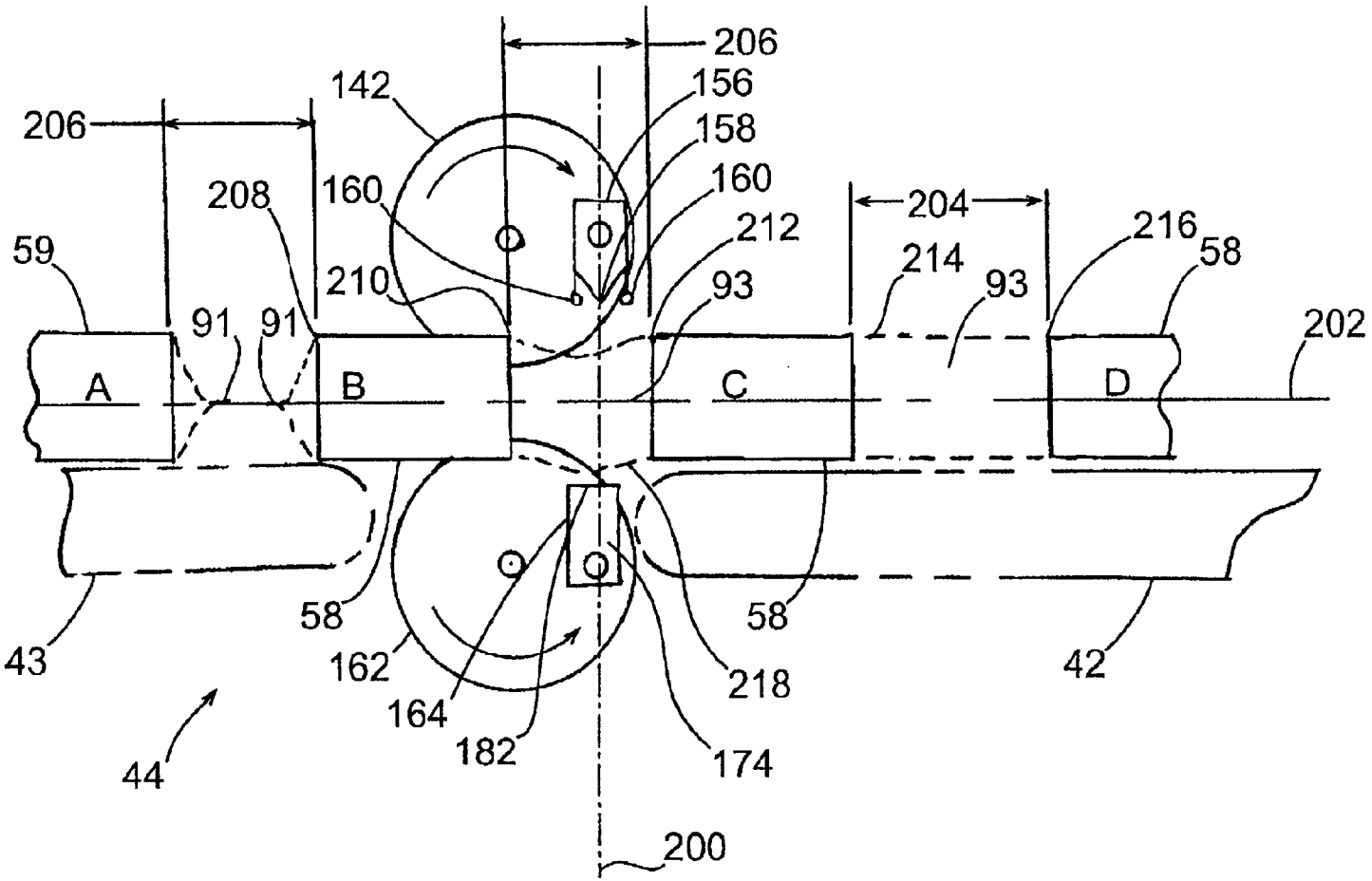
FIG. 6A is a simplified illustration of sealing and cutting operations of the apparatus.

Referring to FIGS. 1 and 6A, vacuum conveyor 42 is disposed adjacent film dispensing station 36 and carries film tube 93 which is very closely wrapped around product 58. Further, by generating a partial pressure along vacuum conveyor 42, products 58 are sequentially conveyed without their being shifted from the position at which product 58 first makes contact with vacuum conveyor 42. Moreover, movement along vacuum conveyor 42 is maintained in synchronization with loading conveyor 34 because the motorized means, preferably a stepper motor, driving vacuum conveyor 42 receives electrical signals generated by sensor 62, which is most preferably a Hall Effect sensor, and which produces a voltage each time a lug 56 passes sensor 62 (not shown). This arrangement permits uniform spacing 150 between adjacent products 58 travelling along the longitudinal axis of vacuum conveyor 42.

Referring to FIGS. 2, 4, 5, and 6A–6D, film sealing and cutting apparatus 44 is disposed at a predetermined fixed distance from vacuum conveyor 42. Additionally, apparatus 44 is configured to move into and out of engagement between adjacent film wrapped products 58. In making these movements, apparatus 44 places a transverse cut 91 or end seal between adjacent sequentially presented products 58 before passing newly separated products 58, or packages 59 (FIGS. 6A, 6D), onto exit conveyor 43.

Figure 4:
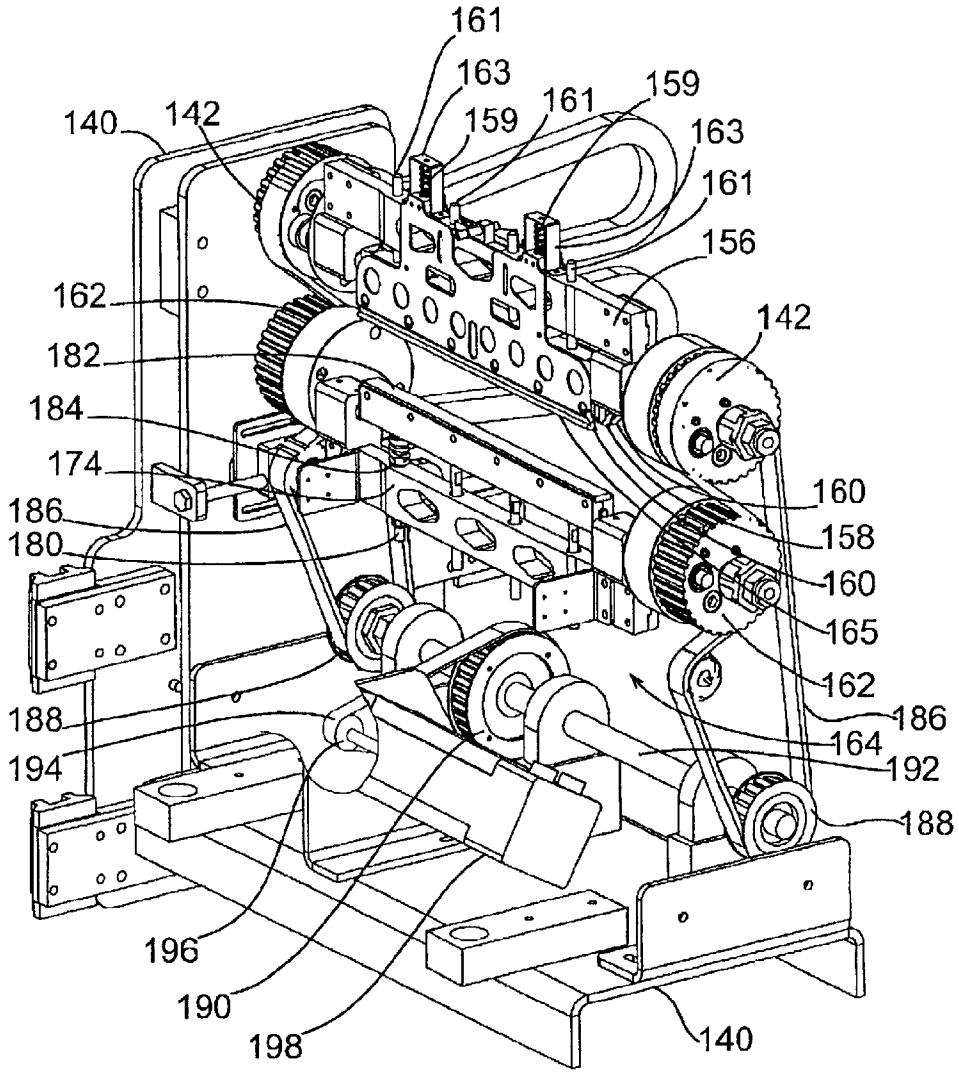
FIG. 4 is a perspective view of heat sealing and cutting apparatus and drive components used in the apparatus of FIG. 1.
Figure 5:
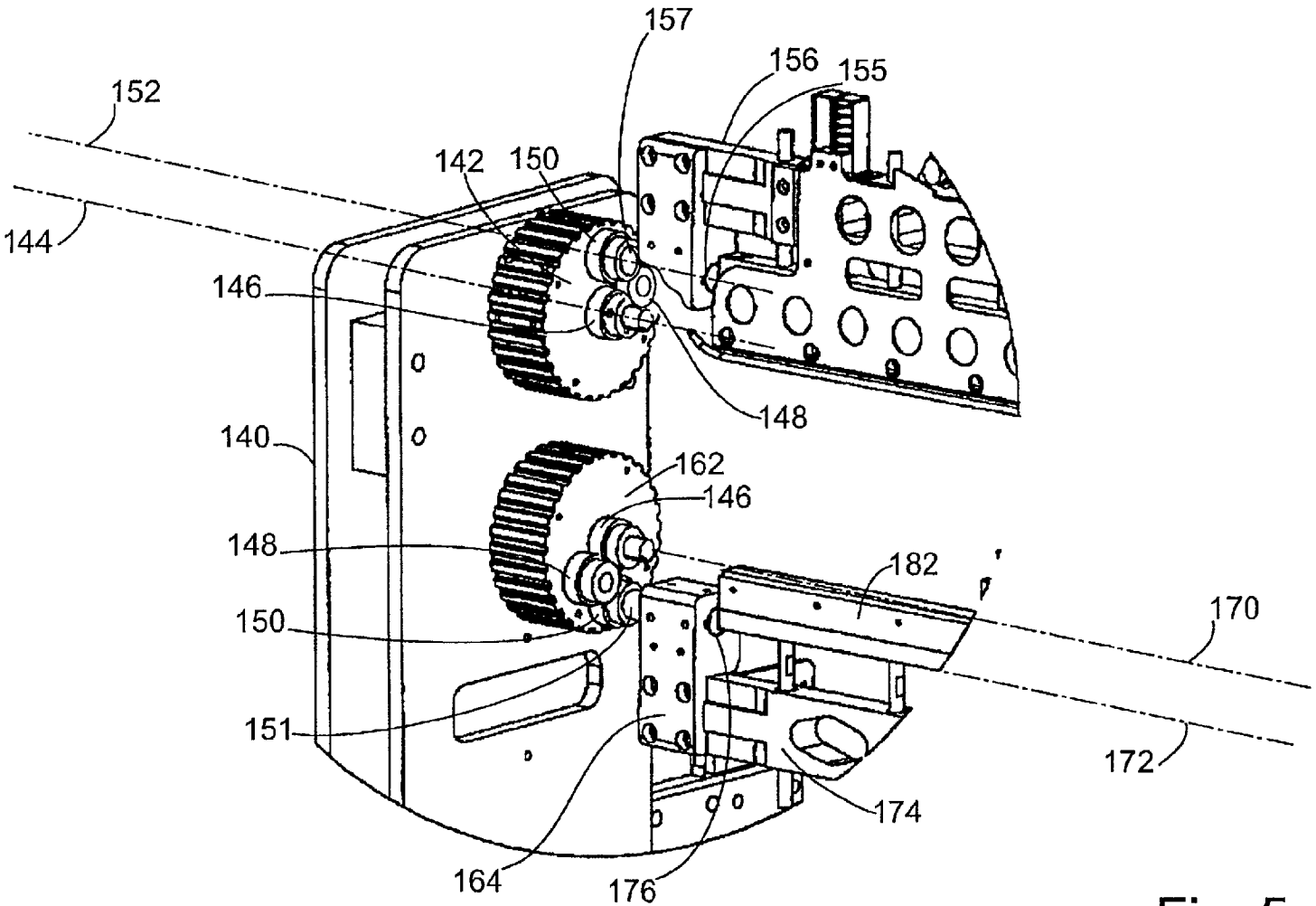
FIG. 5 is a perspective view of a subassembly of FIG. 4.
Figure 5A:
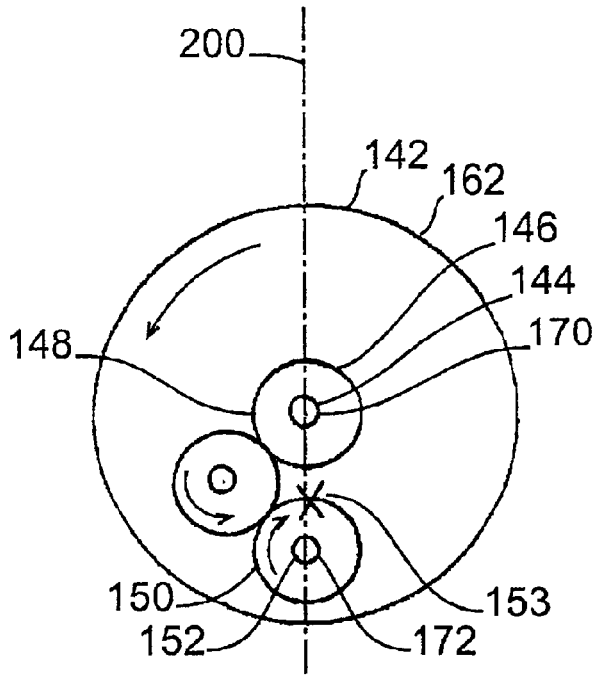
FIG. 5A is a side view of a gear of FIG. 5.

Referring to FIGS. 4 and 5, upper gear 142 is rotatably connected to frame structure 140 about center axis 144. As is shown, fixed central gear 146 is non-rotatably secured along center axis 144. First eccentric gear 148 which is carried by uppergear 142 meshes with central gear 146 that further meshes with second eccentric gear 150 which is also carried by upper gear 142. As is further shown, second eccentric gear 150 rotates about eccentric axis 152.

Figure 5B:
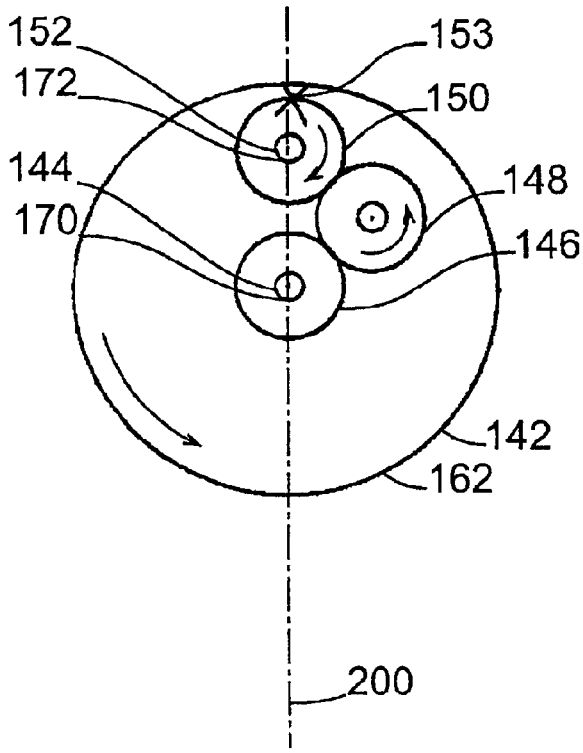
FIG. 5B is a further side view of a gear of FIG. 5 of a gear rotation of 180 degrees.

Therefore, as upper gear 142 rotates about center axis 144, first eccentric gear 148 is urged into rotation by meshing engagement with central gear 146. Additionally, second eccentric gear 150 which rotates about eccentric axis 152 is placed in opposing rotation with respect to upper gear 142. Thus, second eccentric gear 150, although eccentrically rotating about center axis 144, rotates about eccentric axis 152 so that lower gear 162 is maintained in alignment with vertical axis 200. As is shown in FIGS. 5A and 6A–6D, rotation of second eccentric gear 150 about eccentric axis 152 is best explained by use of reference point 153. Reference point 153 in FIG. 5A appears on the upper periphery of second eccentric gear 150 in-line with vertical axis 200. Referring to FIG. 5B, reference point 153 continues to appear at the top vertical position of second eccentric gear 150 in-line with vertical axis 200. Therefore, as shown on FIGS. 5A and 5B and 6A–6B, while lower gear 162 completes a rotation cycle about center axis 170, second eccentric gear 150 rotates about eccentric axis 172 so that upper head 156 remains parallel to vertical axis 200.

Referring to FIGS. 4 and 5, upper head 156 includes a body 154 having a pair of in-line apertures 155 on opposing ends of body 154. Apertures 155 accept opposing shafts 157 which extend from second eccentric gears 150 for rotational orientation with respect to eccentric axis 152. Upper head 156 further includes a cutter portion 158 disposed between a pair of film clamps 160. Cutter portion 158 and film clamps 160 are slidably movable along pins 161. Further, multiple hat-shaped structures 163 are biased against multiple springs 159 to force both cutter portion 158 and film clamps 160 in an extended position.

Referring to FIG. 5, lower gear 162 includes a fixed central gear 146 which is non-rotatably mounted to frame structure 140, although lower gear 162 may rotate about center axis 170. As is shown, first eccentric gear 148 meshes with central gear 146 and second eccentric gear 150 likewise meshes with first eccentric gear 148. Second eccentric gear 150 rotates about eccentric axis 172. Therefore, as lower gear 162 rotates about center axis 170, first eccentric gear 148 is urged into rotation by meshing engagement with central gear 146. Additionally, second eccentric gear 150 which rotates about eccentric axis 172 is placed in opposing rotation with respect to lower gear 162. Thus, second eccentric gear 150, although eccentrically rotating about center axis 170, rotates about eccentric axis 172 so that lower gear 162 is maintained in alignment with vertical axis 200. As is shown in FIGS. 5A and 6A–6D, rotation of second eccentric gear 150 about eccentric axis 152 is best explained by use of reference point 153. Reference point 153 in FIG. 5A appears on the upper periphery of second eccentric gear 150 in-line with vertical axis 200. Referring to FIG. 5B, reference point 153 continues to appear at the top vertical position of second eccentric gear 150 in-line with vertical axis 200. Therefore, as shown on FIGS. 5A and 5B and 6A–6B, while upper gear 142 completes a rotation cycle about center axis 144, second eccentric gear 150 rotates about eccentric axis 152 so that upper head 156 remains parallel to vertical axis 200.

As is shown in FIGS. 4 and 5, lower head 164 includes a body 174 having a pair of in-line apertures 176 on opposing ends of body 174. Apertures 176 accept opposing shafts 151 which extend from second eccentric gears 150 for rotational orientation with respect to eccentric axis 172. Body 174 further includes multiple apertures 178 for accepting in sliding contact therein pins 180 which protrude from platen portion 182. Springs 184 are fitted upon pins 180 prior to insertion into body 174 and bias body 174 in a direction away from platen head portion 182, that is, in a direction along the longitudinal axes of pins 180.

Referring to FIGS. 4 and 5, the interrelationship between upper gear 142 and lower gear 162 is now explained. A pair of serpentine belts 186 mesh about the peripheries of upper gear 142 and lower gear 162. Each serpentine belt 186 meshes an outer pulley 188 secured in non-rotating orientation with respect to a shaft 192, with an inner pulley 190 being disposed between outer pulleys 188 along shaft 192. Shaft 192 is journaled to frame structure 140. As is further shown, a belt 194 engages inner pulley 190 and pulley 196 of motorized means 198, preferably a servo motor. One skilled in the art can appreciate that upper gear 142 and lower gear 162 are being driven in opposing rotational directions about their respective center axes 144, 170. As further appreciated that upper head 156 is carried having a fixed angle of orientation, preferably with vertical axis 200, and that lower head 164 is likewise carried having a fixed angle of orientation, preferably in alignment with vertical axis 200. Referring to FIGS. 6A–6D, it is appreciated that upper head 156 and lower head 164 are maintained synchronously and mutually toward and away from each other about a predetermined path. Thus, cutter portion 158 of upper head 156 and platen head portion 182 of lower head 164 are engaged once for every full rotation of upper gear 142 and lower gear 162. Additionally, due to the rotation of upper head 156 with respect to eccentric axis 152 and lower head 164 with respect to eccentric axis 172, it is appreciated that upper head 156 and the lower head 164 rotate in and out of engagement while maintaining a fixed angle of orientation, preferably in-line with a vertical axis 200. Further, it is appreciated that cutter portion 158 and the platen head portion 182 each maintain a predetermined path, preferably circular, due to the epicyclical arrangement with gears 146, 148 and 150.

Figure 12:
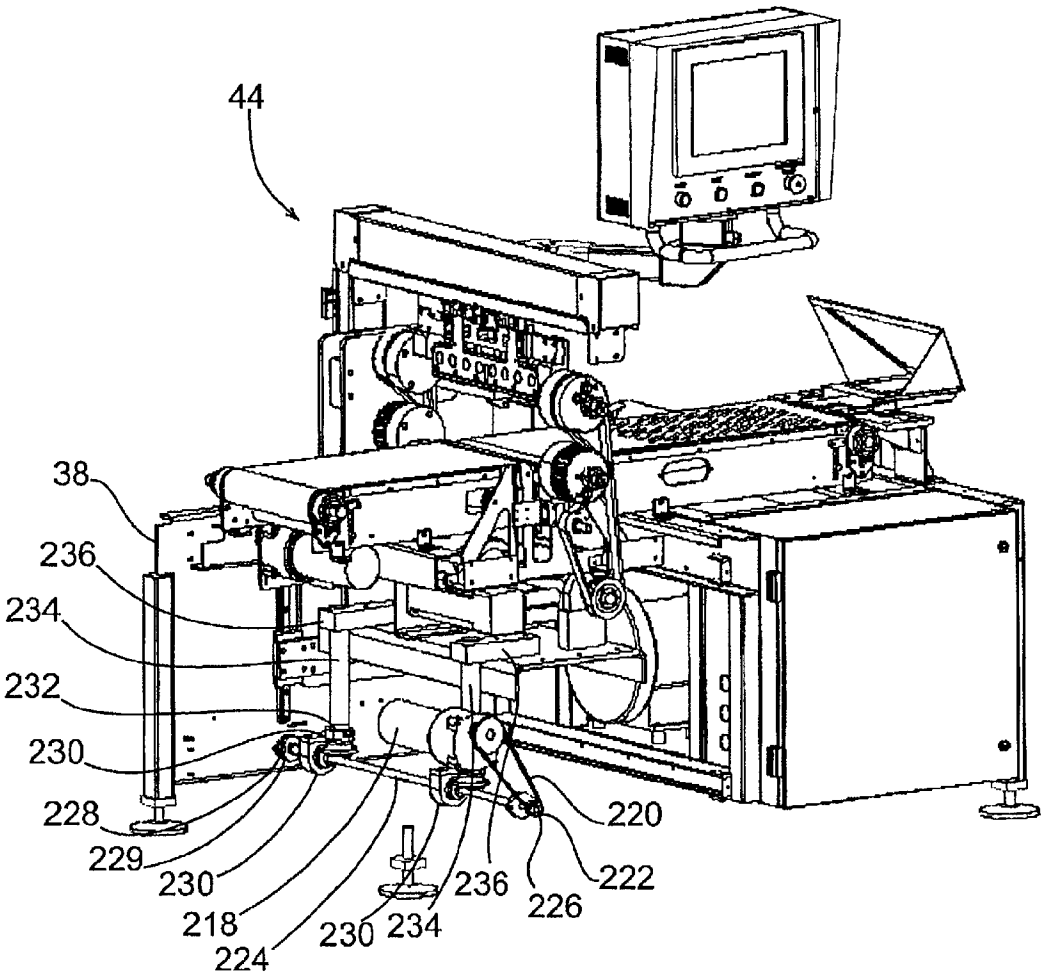
FIG. 12 is a perspective view of apparatus with further panels removed.

Referring to FIG. 12, the vertical adjustment of film sealing and cutting apparatus 44 now disclosed. It is appreciated, that for symmetry, apparatus 44 most efficiently performs its task by engaging film material along a product's mid-point axis 202 (FIG. 6A). Thus, a means to vertically adjust the entire apparatus 44 is required. This is effected, by use of a motorized means 218, such as a permanent D.C. motor. Motorized means 218 is secured to support frame 38 for driving a chain belt 220 which engages a gear 222. Gear 222 is secured to a proximal end 226 of a shaft 224 with a mounting means 228 securing to a distal end 229 of shaft 224. Further, bevel gears 230 are disposed along shaft 224 and at proximal ends 232 of threaded shafts 234. Shafts 234 are threadedly engaged with blocks 236 of apparatus 44. Thus, motorized means 218 drives gear 222, which imparts rotation to shaft 222 that further rotates bevel gears 230 disposed along shaft 224. Further, bevel gears 230 at proximal ends 232 of threaded shafts 234, being meshed with bevel gears 230 along shaft 224, impart rotation about threaded shafts 234. By rotating threaded shafts 234 with respect to blocks 236, apparatus 44 is raised or lowered until the desired height is reached.

Referring to FIGS. 1 and 6A, exit conveyor 50 is disposed in close proximity with apparatus 44 and vacuum conveyor 42. Exit conveyor 50 receives sequentially delivered products 58 from vacuum conveyor 42 and apparatus 44 after a transverse seal 91 has been placed between each adjacent product 58. A motorized means 236 (FIG. 12), preferably a permanent magnet D.C. motor, is utilized to carry products 58 sequentially therefrom in a predetermined relationship with respect to loading conveyor 34. As will be explained in greater detail below, the operator may find it desirable to drive exit conveyor 50 at a lower speed than vacuum conveyor 42 is driven.

Referring to FIGS. 1, 3 and 7, a novel, user-friendly feature of shrink-wrap machine 30 is disclosed. A touch sensitive monitor 48 includes an arm 49 which is pivotally engaged with guard frame 46. Further, film dispensing station 36 includes an open support end 68 from which an operator 47 may either load or unload a roll of film material 92. An operator 47 may grasp monitor 48 and pull monitor 48 towards the operator so that arm 49 pivots about guard frame 46, thus moving monitor 48 on the same side of machine 30 as open support 68 of film dispensing station 36. Additionally, operator 47 may rotate monitor 48 about its base 51 if desired. By having both monitor 48 and open support 68 on the same side of machine 30, maintenance and normal operations are greatly simplified. Moreover, because monitor 48 can be pivoted to either side, and due to interchangeability between support 68 and support 70 of film dispensing station 36, machine 30 is ambidextrous. That is, operator 47 may choose a desired side of operations of machine 30.

Figure 10:
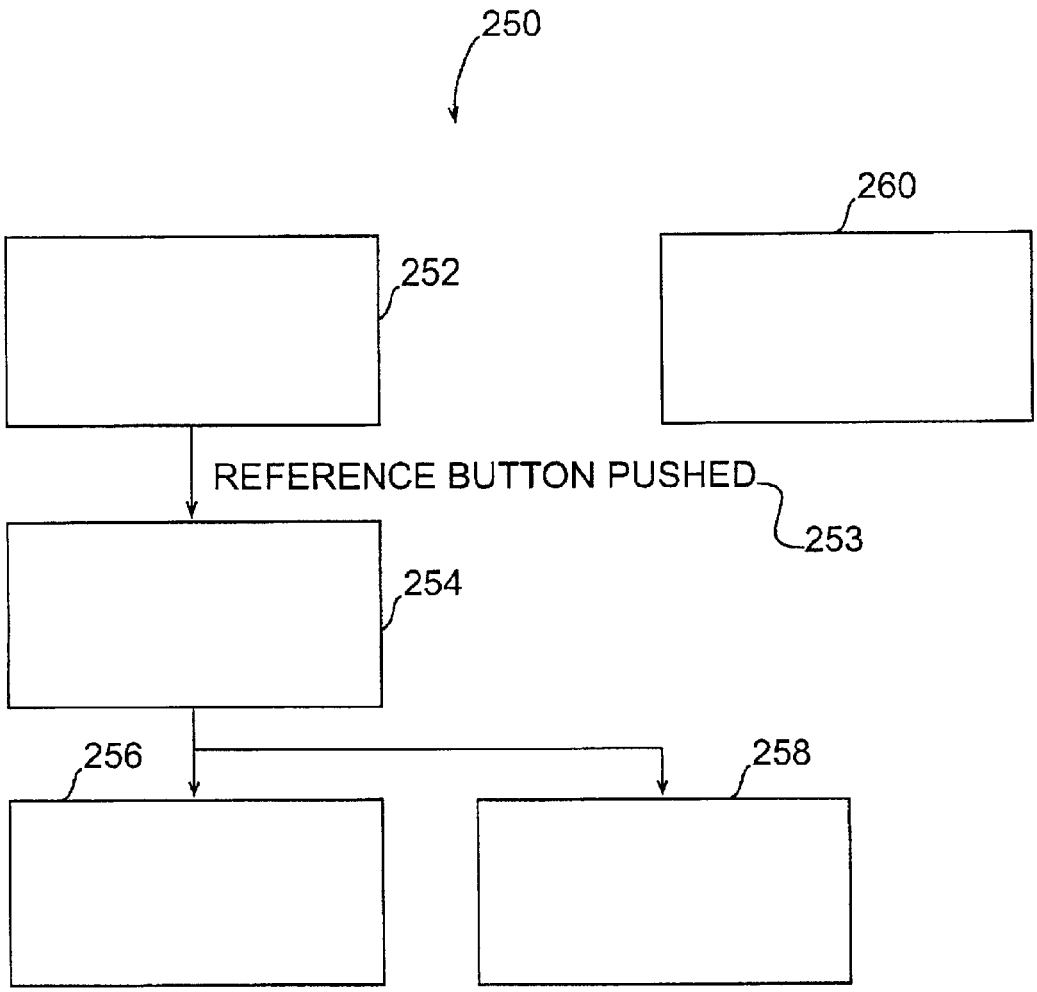
FIG. 10 is a block diagram of software modules of the software of which operates the apparatus.

Referring to FIG. 10, flow diagram 250 is now explained. Flow diagram 250 includes the following modules which are contained in a box and includes set-up program 252, which after a reference button is pushed (Step 253), proceeds into homing program 254 that thereafter proceeds into either main program 256 or to PLC program 258. A fault program 260 continuously runs in the background but is not specifically part of the flow diagram. These microprocessor-driven programs define a control system for the machine.

Set-up program 252 includes initializing variables for operation of the machine and include provision for the operator to:

specify the height, width and length of a package indicate type of seal desired set the speed of the loading conveyor set the speed of exit conveyor set the temperature of cutting head.

Additionally, set-up program 252 sets the scaling for the servo axis which includes a predetermined number of counts per degree rotation of sealing and cutting apparatus 44, and vacuum conveyor 42 which additionally has a predetermined number of counts per unit displacement along the longitudinal direction of vacuum conveyor 42. This scaling permits shrink-wrap machine 30 to extremely accurately calculate the position of products 58 as they proceed down vacuum conveyor 42 and reach apparatus 44. Additionally, set-up program 252 sets error checking bits, the violation which may terminate operation of shrink-wrap machine 30.

Figure 6B:
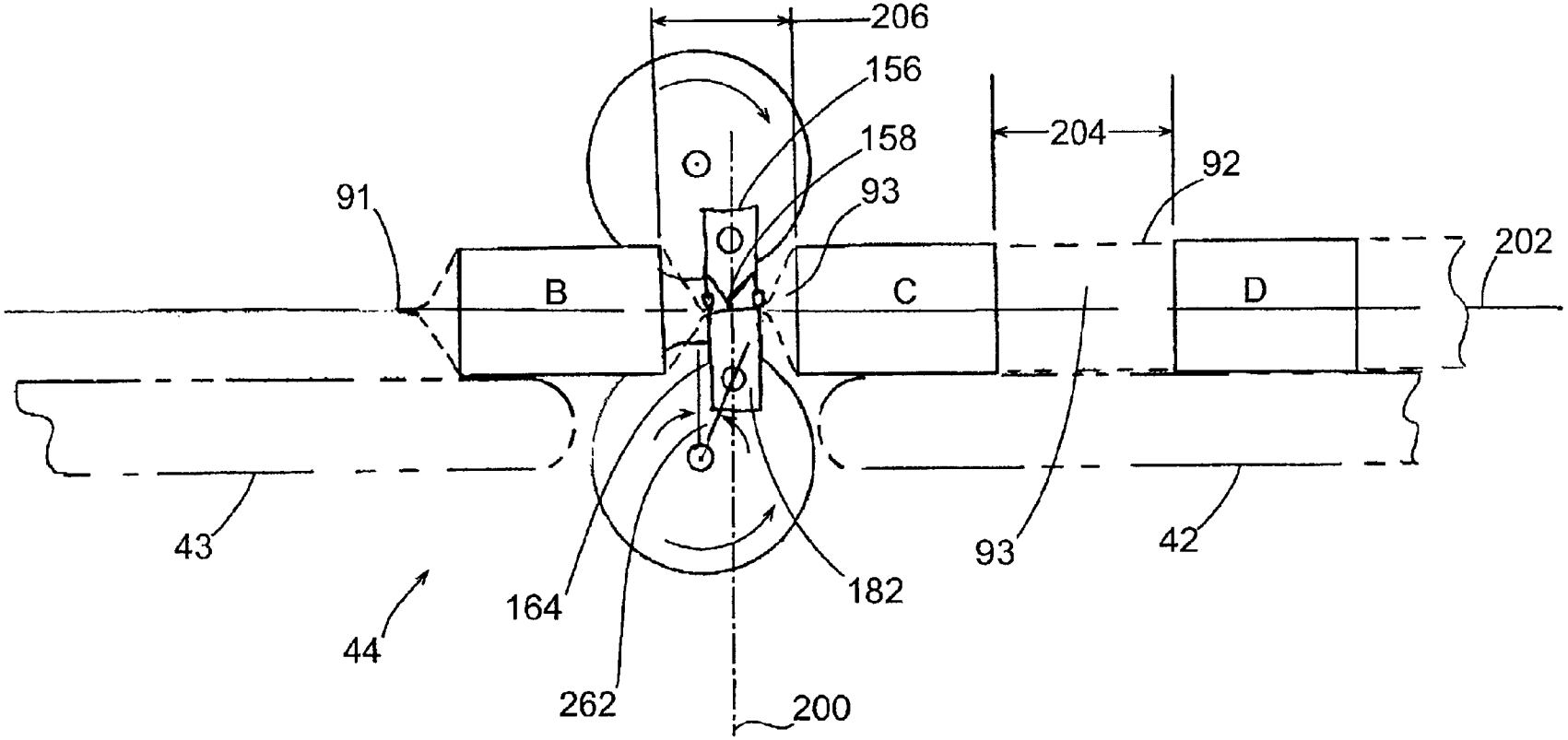
FIG. 6B is a further illustration of a sequence in the cutting and sealing operations.
Figure 6C:
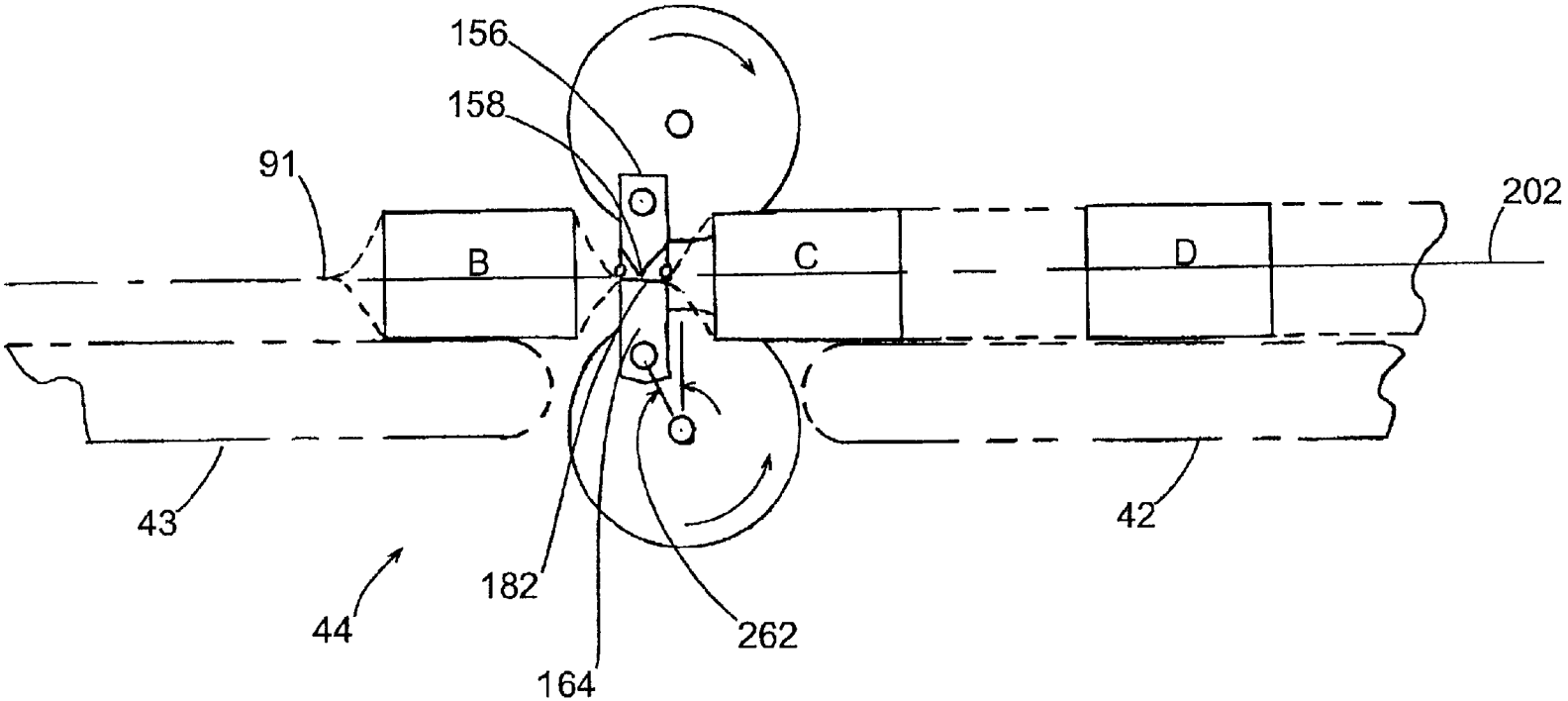
FIG. 6C is still further sequence in a sealing and cutting operation.

Homing program 254 must be initially invoked by depressing reference button 253. Once reference button 253 is depressed, homing program 254 finds the film clamping zone 262 (FIGS. 6B, 6C). Film clamping zone 262 refers to the angular range in which upper head 156 and lower head 164 are in contact with film material 92 between adjacent products. Additionally, homing program 254 calculates the top dead center position (not shown), wherein upper head 156 is located at its uppermost position in its movement cycle and lower head 164 is positioned at its lowest vertical position with respect to its cycle of movement. Therefore, the top bid center position corresponds to the tallest product that the shrink-wrap machine car, accommodate. Moreover, homing program 254 also references the ceiling height to which motorized means 218 must move apparatus 44 so that upper head 156 and lower head 164 are engaged at a height that corresponds to one-half of the height of an incoming product down the vacuum conveyor 42. Main program 256 controls the normal operation of all motor positions or axes. In addition, main program 256 calculates the ratios between web matching and cam following. Web matching refers to matching the speed of product 58 along vacuum conveyor 42 with the horizontal speed of apparatus 44 while upper head 156 and lower head 164 are in the film clamping zone. Cam following refers to the 360 degree rotational speed motion of upper head 156 and lower head 164.

PLC program 258 monitors all machine input and output stations while continuously scanning. Reference button 253 is pushed only when initially turning on the machine and is not again required to be pressed until after a machine is shut off, it is only during the initial turn-on period.

Full program 260 monitors all machine fault bits continuously as it is a program that runs in the background. Fault program 262 monitors commands based on error bit detection, taking predetermined steps to address any particular error. Some error bits can be operator configured such as electing or not electing to activate an alarm when a film roll is expended.

Set-up program 252 permits an operator great flexibility and ease of operation by permitting the operator to input dimensions for different packages to be processed without the operator having to otherwise physically make any other alterations to the shrink-wrap machine.

Referring to FIGS. 1, 2, 3, 3A, 6A–6D, 11, and 11A–11B, the operation of machine 30 shall be discussed. After operator 47 has turned on the machine 30 and has made selections on touch sensitive monitor 48, machine 30 indicates on monitor 48 the proper spacing for lugs 56 along loading conveyor 34. Additionally, the correct wrapping station 40 must be installed into machine 30. Further, at least one roll of film material 92 must be loaded onto film dispensing station 36 and threaded through wrapping station 40 before the wrapping process for products 58 may commence. Products 58 are placed on loading conveyor 34 and properly spaced as shown in FIG. 3A and sequentially propelled into wrapping station 40 by lugs 56. Products 58 then begin to pass in sequential procession through wrapping station 40, wherein each product is closely wrapped peripherally about its longitudinal axis within a continuous tube of film material 93 formed therearound. Opposing ends of shrink-wrap material 92 wrap products 58, forming regions of overlapping shrink-wrap material 81 along the products' longitudinal axes. A sealing device in association with the modular wrapping station 40 (not shown) establishes a continuous seam 77 along the region of overlapping shrink-wrap material 81. It can be appreciated by one skilled in the art that wrapping station 40 may be of multiple configurations. Therefore, the region of overlapping material 81 may be differently configured as would be the sealing arrangement required to establish the seam 77 between overlapping material 81.

Referring to FIG. 6A, products 58 proceeding along vacuum conveyor 42 are snugly wrapped in a tube 93, and move with the film wrap material at a first predetermined spacing 204 therebetween. Products 58 further proceed along vacuum conveyor 42 toward film sealing and cutting apparatus 44 for receiving a transverse seal 91 between each adjacently positioned product 58.

Referring to FIGS. 6A–6D, the process for introducing transverse cuts 91 between adjacent products 58 is now discussed. For clarity, an additional distinction between products is shown by reference characters character A, B, C or D within the product box. Thus, referring to FIG. 6A, package A has already passed film sealing and cutting apparatus 44, is on exit conveyor 43 and ready for delivery into heat chamber (not shown). The term "package" is applied to wrapped products that have received transverse seals of film material in front of its leading end and after its trailing end. Product B has received a transverse seal 91 in front of its leading end 208 with cutter portion 158 and platen head portion 182 rotating in position to place a transverse seal 91 between trailing end 210 of product B and leading end 212 of product C. Further, as shown on FIG. 6A, the spacing between adjacent products such as between product C and product D which initially is first predetermined spacing 204, may be revised or reduced such as between product B and C to a second predetermined spacing 206. This reduced spacing may be desirable for a taller product 58. Therefore, assuming the product 58 to be tall, to effect the shorter second predetermined spacing 206, exit conveyor 43 must operate at a slightly slower speed than that of vacuum conveyor 42. Thus, as leading end 208 of product B comes into contact with exit conveyor 43, the speed of product B becomes slightly less with respect to product C which is still on vacuum conveyor 42, thereby producing second predetermined spacing 206 between product B and product C. This reduced spacing produces a condition of reduced tension of film tube 93 which permit cutter portion 158 and platen head portion 182 to effect an improved transverse seal 91 between product B and product C.

Figure 6D:
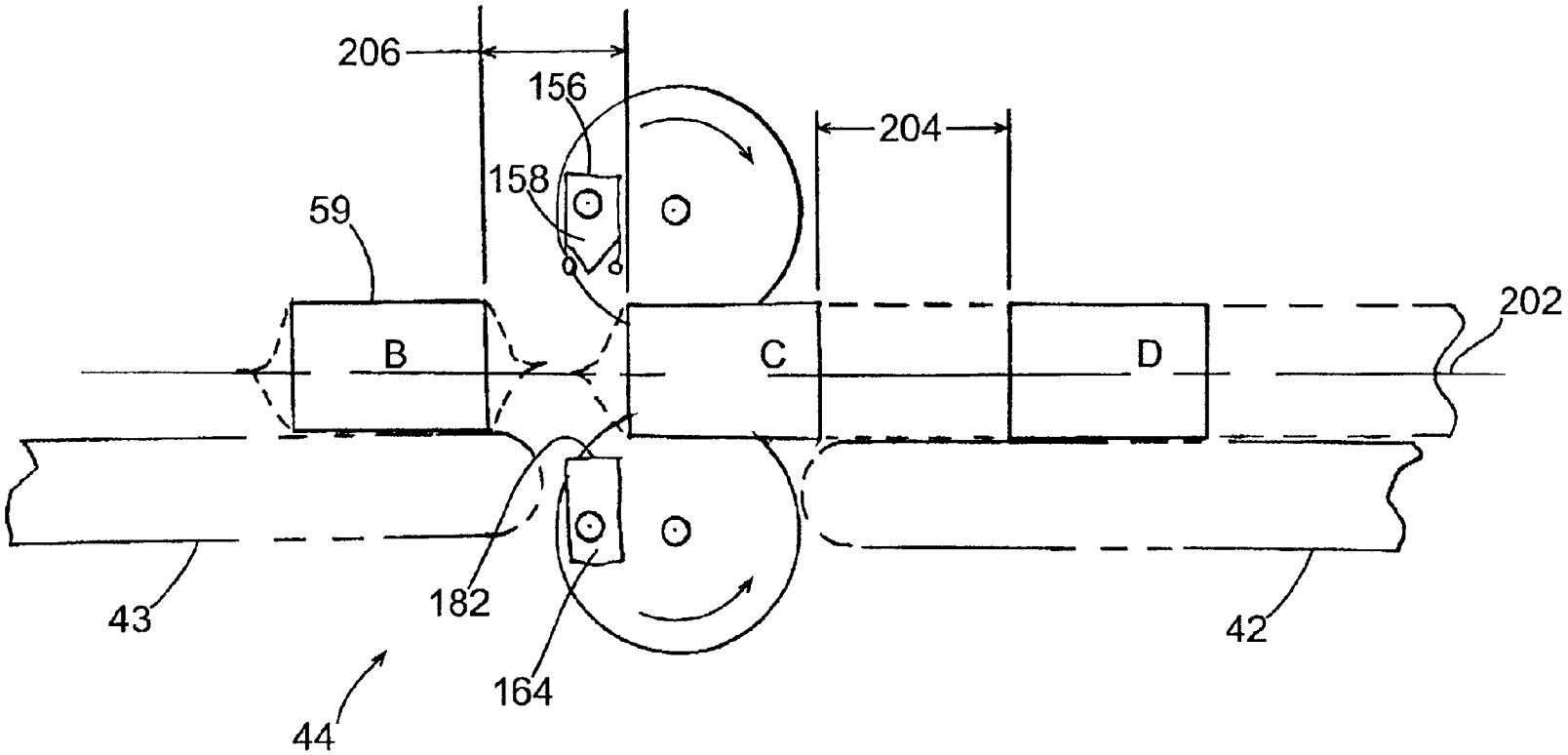
FIG. 6D is a further illustration following a cutting operation.

Referring to FIG. 6B, cutting portion 158 and platen head portion 182 first come into contact with film tube 93. This range of contact between cutter portion 158 and platen head portion 182 is referred to as the film clamping zone 262 which extends 20 degrees to either side of the vertical axis 200. It may be appreciated that maintaining upper head 156 and lower head 164 and fixed relationship therebetween, preferably along vertical axis 200, permits an improved seal due to equal tension of film tube 93 between product B and product C. As is shown on FIG. 6C, cutting head 158 and platen portion 182 remain in contact with each other, and have effected a transverse seal 91 between product B and product C. Further, FIG. 6D shows cutter portion 158 and platen head portion 182 movement out of contact from between product B and product C, transverse seal 91 having been formed therebetween. As is appreciated, this process for establishing transverse seal 91 is sequentially repeated for product C, B and so on.

Figure 13:
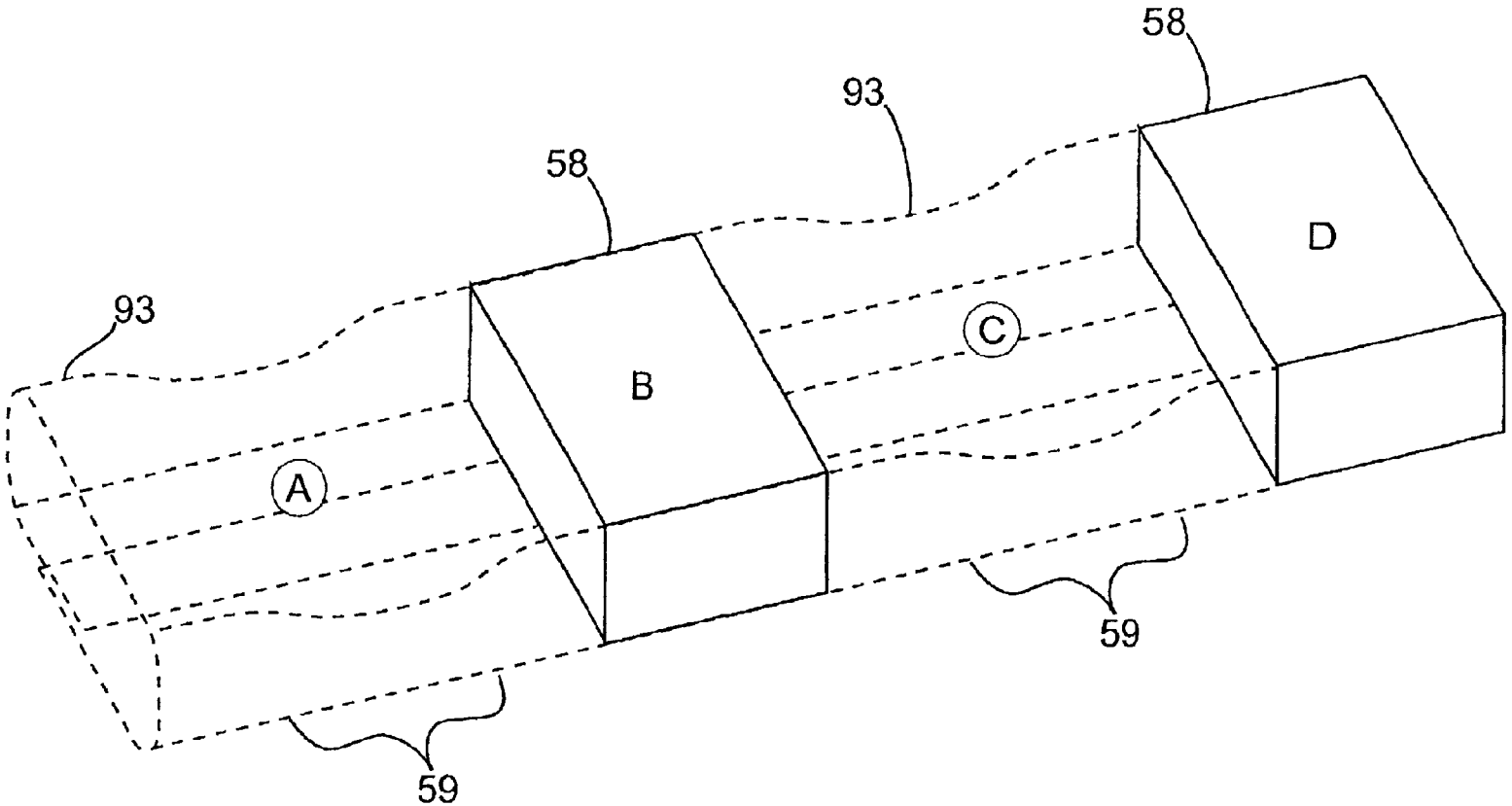
FIG. 13 is a perspective view of products interspersed with missing products along the vacuum conveyor.
Figure 14:
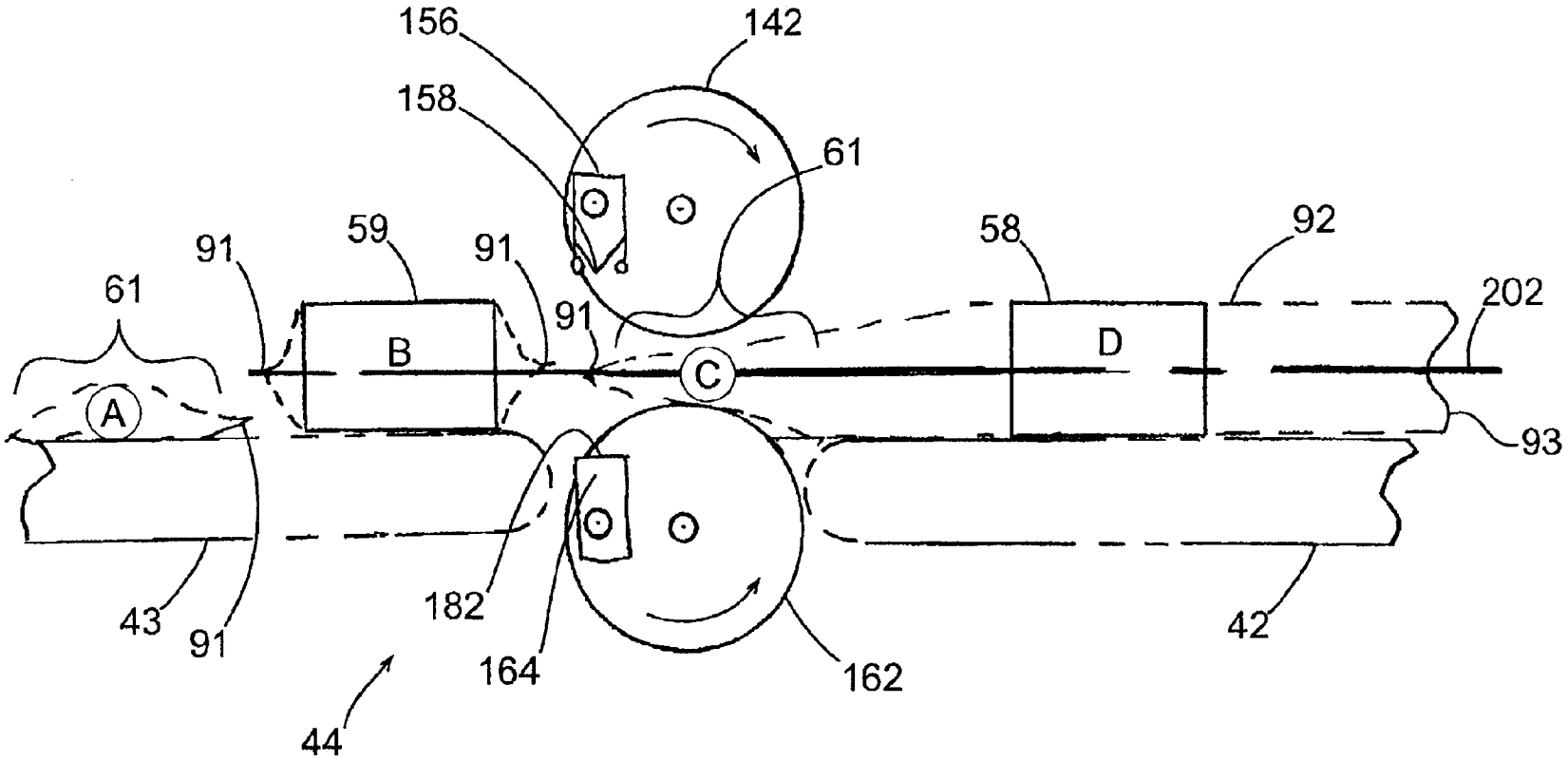
FIG. 14 is a simplified illustration of sealing and cutting operations of the apparatus with missing products interspersed.

Moreover, an additional operational aspect of the machine 30 is discussed. As earlier noted, sensor 62 (not shown) senses a product propelling means 56, preferably lugs, not the product 58 itself. Thus, sensor 62 generates signals corresponding to an anticipated product 58 position, irrespective of the existence of a product 58 in that position. Referring to FIGS. 13 and 14, this "missing product" condition is illustrated. For clarity, an additional distinction between products is shown by reference characters character A, B, C or D within the product box or if there is no product, i.e., a missing product, the character is circled. As is illustrated in FIG. 13 wrapped in continuous film material tube 93, products B and D appear interposed with missing products A and C. Referring to FIG. 14, it is shown that missing product A and product B have been separated by transverse seal 91 and missing product C has received a first transverse seal 91. Therefore, without operator intervention, and so long as sufficient film material 92 remains on film dispensing station 36, machine 30 operates normally. That is, film sealing and cutting apparatus 44 will continue to form transverse seals 91 in film tube 93 between anticipated positions of adjacent products 58.

In addition, a method for controlling a shrink-wrap machine comprises:

a) initializing variables;

b) setting scaling for the sealing head and the vacuum conveyor axes;

c) setting error checking bits;

d) selectively locating a film clamping zone and calculating a top dead center position for the sealing head;

e) controlling normal operations of all motor axes;

f) calculating ratios for web matching and cam following;

g) monitoring all machine input/output ports by continuously scanning same;

h) monitoring continuously all machine fault bits;

i) executing commands based on error bits;

j) repeating steps a)–c) and steps e)–i) upon user re-initialization of package size or other modes as long as machine is not turned off.

In view of the foregoing description of the present invention and various embodiments and methods it will be seen that the several objects of the invention are achieved and other advantages are attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. A selectively reconfigurable shrink-wrap machine for use with a loading device for individually wrapping products sequentially with shrink-wrap material wherein the loading device delivers products in sequence to the machine for wrapping with shrink-wrap material, the shrink-wrap machine comprising:

a sensor associated with the loading device for sensing product position on the loading device;

a film supply for presenting a roll of shrink-wrap material;

a wrapping station at which products are wrapped with film material from the film supply;

a first conveyor for carrying products wrapped in the film material between the wrapping station and a film sealing and cutting apparatus, the first conveyor being driven to deliver products sequentially in synchronized velocity with the loading device in response to signals generated by the sensor;

a second conveyor;

a film sealing and cutting apparatus, the film sealing and cutting apparatus having an upper head and a lower head at least one which heads is driven for movement into and out of engagement with the other head between adjacent film wrapped products received by the first conveyor for effecting a seal between adjacent products, the upper head and lower head traveling mutually toward and away from each other, at least the upper head moving about a predetermined closed geometric path, and engaging once every movement cycle to effect a sealing and cutting operation between adjacent film wrapped products, the upper head and the lower head each maintaining a fixed angle of orientation relative to a direction of movement of products along the first conveyor during travel of the upper head about the predetermined path, the second conveyor being disposed adjacent the film sealing and cutting apparatus for receiving wrapped products sequentially from the sealing and cutting apparatus as they are delivered by the first conveyor and as they are sequentially sealed and cut;

a microprocessor-driven control system having a touch sensitive viewing and controlling means for prompting and receiving operator response for controlling operation of the shrink-wrap machine, the control system having microprocessor circuits selectively programmed for control of at least one of a plurality of different possible wrapping stations or modes of operation the sensor associated with the loading device being such that to sense product position on the loading device, the sensor actually senses a product propelling means on the loading device, whereby the sensor generates signals to the first conveyor for synchronous movement with the loading device so that, irrespective of the presence of products on the loading device, the film sealing and cutting apparatus will continue to effect seals between assumed positions of adjacent products as if the products were present.

2. The shrink-wrap machine according to claim 1 wherein the first conveyor is driven at a lesser velocity than the loading device in response to signals generated by the sensor, the seal between adjacent film wrapped products being enhanced by a leading end portion of a leading adjacent film wrapped product engaging the second conveyor, which travelling at a slower velocity than the first conveyor, to provide reduced spacing between a trailing end of the leading film wrapped product and a leading end of a following adjacent film wrapped product for reducing the amount of film tension therebetween.

3. The shrink-wrap machine according to claim 1 wherein the film sealing and cutting apparatus is driven by a servo motor.

4. The shrink-wrap machine according to claim 1 wherein the first conveyor is driven by a stepper motor.

5. The shrink-wrap machine according to claim 1 wherein the upper and lower heads are each maintained with a vertical axial orientation relative to a direction of movement of products along the first conveyor.

6. The shrink-wrap machine according to claim 1 wherein the upper and lower heads are each maintained with a vertical axial orientation relative to a direction of movement of products along the first conveyor by an epicyclical engagement therewith.

7. The shrink-wrap machine according to claim 1 wherein the upper head and lower head each travel mutually toward and away from each other as each of the upper head and lower heads moves about a closed geometric path.

8. The shrink-wrap machine according to claim 1 wherein the upper head and lower head travel each mutually toward and away from each other about a circular path.

9. The shrink-wrap machine according to claim 1 wherein the control system permits the operator to selectively input a plurality of sets of package dimensions and pertinent operating parameters and to save each set of package dimensions and pertinent parameters for immediate future retrieval by the operator.

10. The shrink-wrap machine according to claim 1 wherein the operator can reconfigure the shrink-wrap machine to accept a product having different dimensions without having to make any other adjustments to the shrink-wrap machine.

11. The shrink-wrap machine according to claim 1 wherein the viewing and controlling means is selectively configurable such that an operator can be situated to either side of the shrink-wrap machine to operate and monitor the shrink-wrap machine, whereby operation of the machine is ambidextrous.

12. The shrink-wrap machine according to claim 1 wherein the film supply includes a film delivery apparatus having a pair of vertical support members further having a spindle member interposed therebetween for carrying a roll of shrink-wrap film to present film to the wrapping station, the spindle member includes an outside shaft journaled about a central shaft nonrotatably connected at a proximal end to one of the vertical support members, an adjustment collar and an adjacent locking nut threadedly engaged with a distal end of the central shaft, the locking nut for preventing the adjustment collar from rotating with respect to the central shaft by rotating the locking nut with respect to the adjustment collar until there is secure contact therebetween, the adjustment collar permitting an operator to adjust the position of a roll of shrink-wrap film along the longitudinal axis of the hollow shaft while the shrink-wrap machine is in operation.

13. A selectively reconfigurable shrink-wrap machine for use with a loading device for individually wrapping products sequentially with shrink-wrap material wherein the loading device delivers products in sequence to the machine for wrapping with shrink-wrap material, the shrink-wrap machine comprising:

a sensor associated with the loading device for sensing product position on the loading device;

a film supply for presenting a roll of shrink-wrap, material;

a wrapping station at which products are wrapped with film material from the film supply;

a first conveyor for carrying products wrapped in the film material between the wrapping station and a film sealing and cutting apparatus, the first conveyor being driven to deliver products sequentially in synchronized velocity with the loading device in response to signals generated by the sensor;

a second conveyor;

film sealing and cutting apparatus;

the film sealing and cutting apparatus having an upper head and a lower head at least one which heads is driven for movement into and out of engagement with the other head between adjacent film wrapped products received by the first conveyor for effecting a seal between adjacent products, the upper head and lower head travel mutually toward and away from each other about a predetermined path engaging once every movement cycle to effect a sealing and cutting operation between adjacent film wrapped products;

the upper head and the lower head each maintaining a fixed angle of orientation relative to a direction of movement of products along the first conveyor, the second conveyor being disposed adjacent the film sealing and cutting apparatus for receiving wrapped products sequentially from the sealing and cutting apparatus as they are delivered by the first conveyor and as they are sequentially sealed and cut;

a microprocessor-driven control system having a touch sensitive viewing and controlling means for prompting and receiving operator response for controlling operation of the shrink-wrap machine, the control system having microprocessor circuits selectively programmed for control of at least one of a plurality of different possible wrapping stations or modes of operation;

wherein one of the vertical support members includes at least one pair of first and second sensing devices mounted thereon connected to an operator warning device for warning the operator of a predetermined extent of depletion and of total depletion, respectively, of a roll of shrink-wrap film used with the shrink-wrap machine;

an indexing device including an elongated portion having a proximal end and a distal end extending through the vertical support member in rotational engagement therewith for correlating the extent of film roll depletion to the sensing devices;

a first sensing member extending from the proximal end of the elongated portion and a second sensing member extending from the distal end of the elongated portion, the first and second sensing members being in a predetermined angular relationship with each other with respect to the longitudinal axis of the elongated portion;

a retarding device including an elongated member extending from the vertical support member securing a flexible retarding member in non-marring frictional engagement with the periphery of a roll of shrink-wrap film, the first sensing member resting atop the flexible retarding member for monitoring the amount of shrink-wrap material remaining on a roll, the second sensing member pivotally adjacent the first and second sensing devices; wherein as the roll of shrink-wrap film is expended, the first sensing member which maintains an offset tangential contact along the radius of the roll due to the thickness of the flexible retarding member, rotates about the longitudinal axis of the elongated portion, as does the second sensing member, wherein as the film roll of shrink-wrap film is expended to a predetermined level, the second sensing member achieving such proximity with the first sensing device as to activate the first sensing device and thereby alert the operator of a predetermined level of depletion of a film roll, and upon the roll being totally expended, the second sensing member achieving such proximity with the second sensing device as to activate the second sensing device and thereby alert the operator that the film roll has been totally expended;

wherein the first conveyor is driven at a lesser velocity than the loading device in response to signals generated by the sensor, the seal between adjacent film wrapped products being enhanced by a leading end portion of a leading adjacent film wrapped product engaging the second conveyor, which travelling at a slower velocity than the first conveyor, to provide reduced spacing between a trailing end of the leading film wrapped product and a leading end of a following adjacent film wrapped product for reducing the amount of film tension therebetween.

14. A selectively reconfigurable shrink-wrap machine for use with a loading conveyor for individually wrapping products sequentially with shrink-wrap material wherein the loading conveyor delivers products in sequence to the machine for wrapping with shrink-wrap material and includes a plurality of lugs positioned at predetermined spacing intervals along the periphery of the loading conveyor such that products on the loading conveyor are positioned between adjacent lugs and in contact with at least one of the lugs with respect to the direction of travel of the loading conveyor, the shrink-wrap machine comprising:

a sensor associated with the loading conveyor for sensing the position of the lugs as the lugs travel past the sensor;

a film supply disposed adjacent the loading conveyor including a film delivery apparatus for presenting a roll of shrink-wrap material;

a modular wrapping station for wrapping products by directing film material from the film supply and through the wrapping station to closely enwrap products peripherally along their longitudinal axes within a continuous tube of the film material so that the tube is formed therearound, wherein opposing ends of shrink-wrap material enwrapping the products form a region of overlapping shrink-wrap material along the products' longitudinal axes, the modular wrapping station being disposed adjacent the loading conveyor, the lugs propelling the products into the wrapping station;

a sealing device in association with the modular wrapping station for establishing a continuous seam along the region of overlapping shrink-wrap material of the tube by bonding the overlapping opposing ends of the shrink-wrap material to one another as the continuous tube of film material securely containing the products therein travels past the sealing device;

a vacuum conveyor associated with the modular wrapping station for carrying the tube containing the closely wrapped products therein away from the sealing device after the sealing device has established the continuous seam along the region of overlapping shrink-wrap material by pulling the tube along its longitudinal axis, the vacuum conveyor being driven by a motorized means to deliver products sequentially in synchronized velocity with the loading conveyor in response to electrical signals generated by the sensor;

an exit conveyor;

a film sealing and cutting apparatus for movement into and out of engagement between adjacent film wrapped products such that as the sealing and cutting apparatus moves in and out of engagement it maintains a fixed angle of orientation that does not change relative to a direction of movement of products along the first conveyor during movement of the sealing and cutting apparatus, the sealing and cutting apparatus being disposed between the vacuum conveyor and the exit conveyor and including an upper head having a cutter portion eccentrically positioned thereon, the cutter portion being maintained with a predetermined axial orientation relative to a direction of movement of products along the vacuum conveyor by a predetermined engagement therewith; and further including a lower head having a platen head portion, the path of the cutter portion being predetermined, the cutter portion and the platen head portion being synchronously maintained mutually toward and away from each other by movement about a closed geometric predetermined path, wherein the platen head portion and the cutter head portion are engaged once every full movement cycle of the upper and the lower heads to effect a sealing and cutting operation between adjacent film wrapped products, the exit conveyor adjacently disposed closely proximate the film sealing and cutting apparatus and at a predetermined gap from the vacuum conveyor for carrying products sequentially therefrom, the film sealing and cutting apparatus being driven by a motorized means to deliver products sequentially in synchronized velocity with the loading conveyor in response to electric signals generated by the sensor, the exit conveyor being driven by a motorized means at a predetermined velocity with respect to the loading conveyor in response to electrical signals generated by the sensor; and the sensor associated with the loading device being such that to sense product position on the loading device, the sensor actually senses a product propelling means on the loading device, whereby the sensor generates signals to the first conveyor for synchronous movement with the loading device so that, irrespective of the presence of products on the loading device, the film sealing and cutting apparatus will continue to effect seals between assumed positions of adjacent products as if the products were present;

a computer programmed control system which includes a touch sensitive viewing and controlling means for prompting and receiving operator response to control operation of the shrink-wrap machine, the control system having microprocessor circuits which are selectively programmed for control of at least one of a plurality of different possible modular wrapping stations or modes of operation, the different wrapping stations being configured to apply a unique sealing arrangement along region of overlapping shrink-wrap material enwrapping the products, the control system prompting an operator to selectively input the dimensions of a package and other pertinent operating parameters by manually interacting with the touch sensitive viewing and controlling means, the control system additionally permitting the operator to selectively input a plurality of sets of package dimensions and pertinent operating parameters and to save each set of package dimensions and pertinent parameters for immediate future retrieval by the operator, wherein the operator may reconfigure the shrink-wrap machine to accept a product having different dimensions without having to make any other adjustments to the shrink-wrap machine, and wherein the viewing and controlling means are selectively configurable such that an operator can be situated to either side of the shrink-wrap machine to operate and monitor the shrink-wrap machine, whereby operation of the machine is ambidextrous.

* * * * *